US010723031B2

(12) United States Patent
Park et al.

(10) Patent No.: US 10,723,031 B2
(45) Date of Patent: Jul. 28, 2020

(54) RAZOR CARTRIDGE WITH VARIABLE BLADE SPAN

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/382,581

(22) Filed: Apr. 12, 2019

(65) Prior Publication Data

US 2019/0315009 A1 Oct. 17, 2019

(30) Foreign Application Priority Data

Apr. 12, 2018 (KR) ..... 10-2018-0042780

(51) Int. Cl.
*B26B 21/40* (2006.01)
*B26B 21/22* (2006.01)

(52) U.S. Cl.
CPC ..... *B26B 21/4062* (2013.01); *B26B 21/222* (2013.01)

(58) Field of Classification Search
CPC ... B26B 21/222; B26B 21/40; B26B 21/4031; B26B 21/4062
See application file for complete search history.

(56) References Cited

U.S. PATENT DOCUMENTS 1,121,916 A * 12/1914 Gaisman ..... B26B 21/16 30/57
1,920,711 A * 8/1933 Pelizzola ..... B26B 21/22 30/50
4,200,976 A * 5/1980 Gooding ..... B26B 21/222 219/121.13
4,345,374 A * 8/1982 Jacobson ..... B26B 21/222 30/47

(Continued)

FOREIGN PATENT DOCUMENTS

DE 102004020650 11/2005
DE 202015102464 6/2015

(Continued)

OTHER PUBLICATIONS

European Patent Office Application Serial No. 19168716.9, Search Report dated Sep. 12, 2019, 6 pages.

(Continued)

*Primary Examiner* — Sean M Michalski
(74) *Attorney, Agent, or Firm* — Lee, Hong, Degerman, Kang & Waimey

(57) ABSTRACT

The present disclosure relates to a razor cartridge with variable blade span(s), the razoar cartridge including a plurality of blades; a plurality of blade housings extended in a first direction and having seats configured to support the plurality of blades; a cartridge frame having one or more rails configured to support the plurality of blade housings such that the plurality of housings are movable along the one or more rails in a second direction perpendicular to the first (Continued)

direction; and a span adjusting shifter coupled to the plurality of blade housings and configured to cause the plurality of blade housings to move along the one or more rails in the second direction.

15 Claims, 23 Drawing Sheets

(56) References Cited

U.S. PATENT DOCUMENTS

| | | | | |
|---|---|---|---|---|
| 4,586,255 | A * | 5/1986 | Jacobson | B26B 21/227 30/41 |
| 4,709,477 | A * | 12/1987 | Ferraro | B26B 21/227 30/50 |
| 4,774,765 | A * | 10/1988 | Ferraro | B26B 21/227 30/50 |
| 5,084,969 | A * | 2/1992 | Althaus | B26B 21/4018 30/50 |
| 5,313,706 | A * | 5/1994 | Motta | B26B 21/227 30/47 |
| 5,687,485 | A | 11/1997 | Shurtleff et al. | |
| 5,761,814 | A | 6/1998 | Anderson et al. | |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,173,498 | B1 | 1/2001 | Warrick et al. | |
| 6,185,822 | B1 | 2/2001 | Tseng et al. | |
| 6,212,777 | B1 * | 4/2001 | Gilder | B26B 21/4031 30/50 |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 7,200,938 | B2 | 4/2007 | Lembke | |
| 7,367,125 | B2 * | 5/2008 | Aviza | B26B 21/443 30/34.05 |
| 10,562,198 | B2 * | 2/2020 | Clarke | B26B 21/4018 |
| 2010/0218381 | A1 * | 9/2010 | Follo | B26B 21/44 30/77 |
| 2016/0346944 | A1 | 12/2016 | Sadrialaei | |

FOREIGN PATENT DOCUMENTS

| | | |
|---|---|---|
| JP | 2003220285 | 8/2003 |
| KR | 101774370 | 9/2017 |
| WO | 2012070038 | 5/2012 |

OTHER PUBLICATIONS

Korean Intellectual Property Office Application No. 10-2018-0042780, Office Action dated May 19, 2019, 6 pages.

* cited by examiner

RAZOR CARTRIDGE WITH VARIABLE BLADE SPAN

CROSS-REFERENCE TO RELATED APPLICATIONS

Pursuant to 35 U.S.C. § 119(a), this application claims the benefit of earlier filing date and right of priority to Korean Patent Application No. 10-2018-0042780, filed on Apr. 12, 2018, the contents of which are all hereby incorporated by reference herein in its entirety.

TECHNICAL FIELD

The present disclosure relates to a razor cartridge and more particularly to a razor cartridge of which spacing of a plurality of blades or a blade span is adjustable.

BACKGROUND

A typical razor cartridge is composed of blades and a blade housing, generally including one or more seats onto which the blades get seated. The blades are seated on the seats, and a single razor cartridge is formed by using a clip for wrapping, i.e., coupling firmly, the blades and the blade housing to allow the blades to be fixed.

The blade housing may be provided with a single seat for mounting a single blade, although a pervasive trend in the razor cartridge art is to form a plurality of seats for multiple blades, positioned in a close arrangement, to allow body/facial hairs to be repeatly and reliably cut.

The seat is generally integrally formed with the blade housing and fixes the blades to the blade housing such that the seat engages the rear end of each blade opposite its cutting edge. Accordingly, the interval or spacing between the plurality of blades is determined according to the interval in which the seats are arranged. The spacing between the plurality of blades is referred to as a "span."

In designing a razor cartridge, determining a proper span is an important issue. If the span is too large, it may facilitate the cleaning of the sludge, which is the residue from the hair cutting process, but it may also increase skin irritation. If the span is too small, although it may lead to skin irritation being reduced, it may also lead to insufficient cleaning of the sludge.

There are advantages and disadvantages depending on the span value and the preferred span value for each user may be different. However, as described above, the blade housing of a razor cartridge is generally formed so that once determined, a span value becomes unchangeable, making it impossible to customize the razor cartridge according to the user's needs or preference.

DISCLOSURE

Technical Problem

The present disclosure provides a razor cartridge including a plurality of blades, wherein a span, which is an interval between the blades, is adjustable by a user.

The above and other issues are addressed by the present disclosure, which can be clearly understood by those skilled in the art from the following description.

Summary

At least one embodiment of the present disclosure provides a razor cartridge including a plurality of blades; a plurality of blade housings extended in a first direction and having seats configured to support the plurality of blades; a cartridge frame having one or more rails configured to support the plurality of blade housings such that the plurality of housings are movable along the one or more rails in a second direction perpendicular to the first direction; and a span adjusting shifter coupled to the plurality of blade housings and configured to cause the plurality of blade housings to move along the one or more rails in the second direction.

At least another embodiment of the present disclosure provides a razor cartridge including a plurality of blades; a plurality of blade housings extended in a first direction and having seats configured to support the plurality of blades; a cartridge frame having one or more rails configured to support the plurality of blade housings such that the plurality of blade housings are movable along the one or more rails in a second direction perpendicular to the first direction; and a lower guard supported by the one or more rails and movable along the one or more rails in the second direction with the plurality of blade housings, wherein: the plurality of blade housings are interconnected along the second direction; the lower guard is connected to one or more blade housings adjacent to the lower guard among the plurality of blade housings; and the razor cartridge further comprises a span adjusting shifter configured to be moved in the first direction causing the lower guard to be moved in the second direction, wherein the interconnected plurality of blade housings are moved in the second direction in response to the lower guard moving in the second direction.

The details of other embodiments are included in the detailed description and drawings.

Advantageous Effects

The embodiments of the present disclosure provide the following effects.

The span can be arbitrarily adjusted by the user, allowing the razor cartridge to suit the user's needs and taste.

After cutting the body/facial hairs in a narrow span condition with less irritation, the shaved residue can be effectively washed out by making the span wider.

The effects according to the present disclosure are not limited by those exemplified above, and more various effects are included in the specification. Other unmentioned effects may be clearly understood by those skilled in the art from the description of the claims.

DETAILED DESCRIPTION

Figure 1:
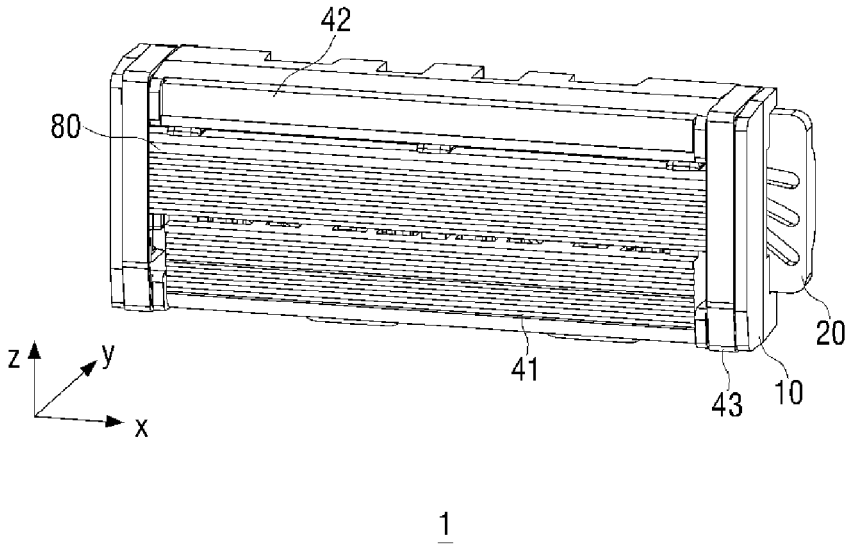
FIG. 1 is a perspective view of a razor cartridge according to a first exemplary embodiment of the present disclosure.

The advantages and features of the present disclosure and the manner of achieving them will become apparent with reference to the embodiments described in detail below with reference to the accompanying drawings. The present disclosure may, however, be embodied in many different forms and should not be construed as limited to the embodiments set forth herein. Rather, these embodiments are provided so that this disclosure will be thorough and complete, and to fully disclose the scope of the disclosure to those skilled in the art. The disclosure is only defined by the scope of the claims. Like reference numerals designate like elements throughout the specification.

Unless defined otherwise, all terms (including technical and scientific terms) used herein may be used in a sense commonly understood by one of ordinary skill in the art to which this disclosure belongs. In addition, commonly used dictionary defined terms are not ideally or excessively interpreted unless explicitly defined otherwise.

The terminology used herein is for the purpose of illustrating embodiments and is not intended to be limiting of the present disclosure. In the present specification, a singular form of nouns includes their plural forms unless otherwise specified in the specification. Throughout this specification, when a part "comprises" and/or is "comprising" an element, present disclosure does not exclude the presence or addition of one or more other elements in addition to the stated element.

Further, the embodiments herein will be described with reference to cross-sectional views and/or schematic drawings that are ideal illustrations of the present disclosure. Thus, the shape of the illustrations may be modified by manufacturing techniques and/or tolerances. In addition, in the drawings of the present disclosure, each component may be somewhat enlarged or reduced in view of convenience of explanation. Like reference numerals refer to like elements throughout the specification, and the term "and/or" is intended to include each and every combination of one or more of the mentioned items.

Spatially relative terms should be understood in terms of the directions shown in the drawings, further including the different directions of components at the time of use or operation. The components can also be oriented in other directions, so that spatially relative terms can be interpreted according to orientation.

Hereinafter, the configuration of some embodiments of the present disclosure will be described in detail with reference to the accompanying drawings.

Figure 2:
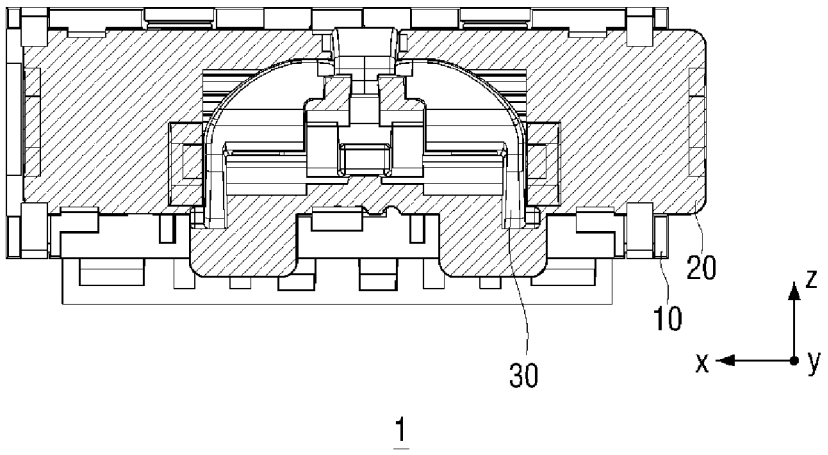
FIG. 2 is a rear view of the razor cartridge according to the first embodiment.

FIG. 1 is a perspective view of a razor cartridge 1 according to a first embodiment of the present disclosure. FIG. 2 is a rear view of the razor cartridge 1 according to the first embodiment.

Referring to FIGS. 1 and 2, a razor cartridge 1 according to the first embodiment includes a plurality of blades 80, a cartridge frame 10 that accommodates the plurality of blades 80, a span adjusting shifter 20 slidably coupled to the rear of the cartridge frame 10, a connector 30 coupled to the rear of the span adjusting shifter 20, a lower guard 41 and an upper guard 42 respectively disposed below and above the plurality of blades 80, and clips 43 formed to wrap around the cartridge frame 10.

In the specification of the present disclosure and along the y-axis shown in the drawings, the connector 30 is connected to the rear side of the cartridge frame 10, and the cartridge frame 10 is connected to the front side of the connector 30.

Further, along the z-axis shown in the drawings, the lower guard 41 is positioned below the plurality of blades 80, and the upper guard 42 is located above the blades 80. A side or lateral direction means a direction parallel to the x-axis.

The longitudinal direction of the cartridge frame 10, in which the cartridge frame 10 extends, is parallel to the x-axis, and the breadthwise direction is parallel to the z-axis. As used in the specification of the present disclosure, a first direction refers to both directions parallel to the x-axis direction, and a second direction refers to both directions parallel to the z-axis direction.

Hereinafter, the respective components and their coupling structure will be described in detail with reference to FIGS. 3 and 4.

Figure 3:
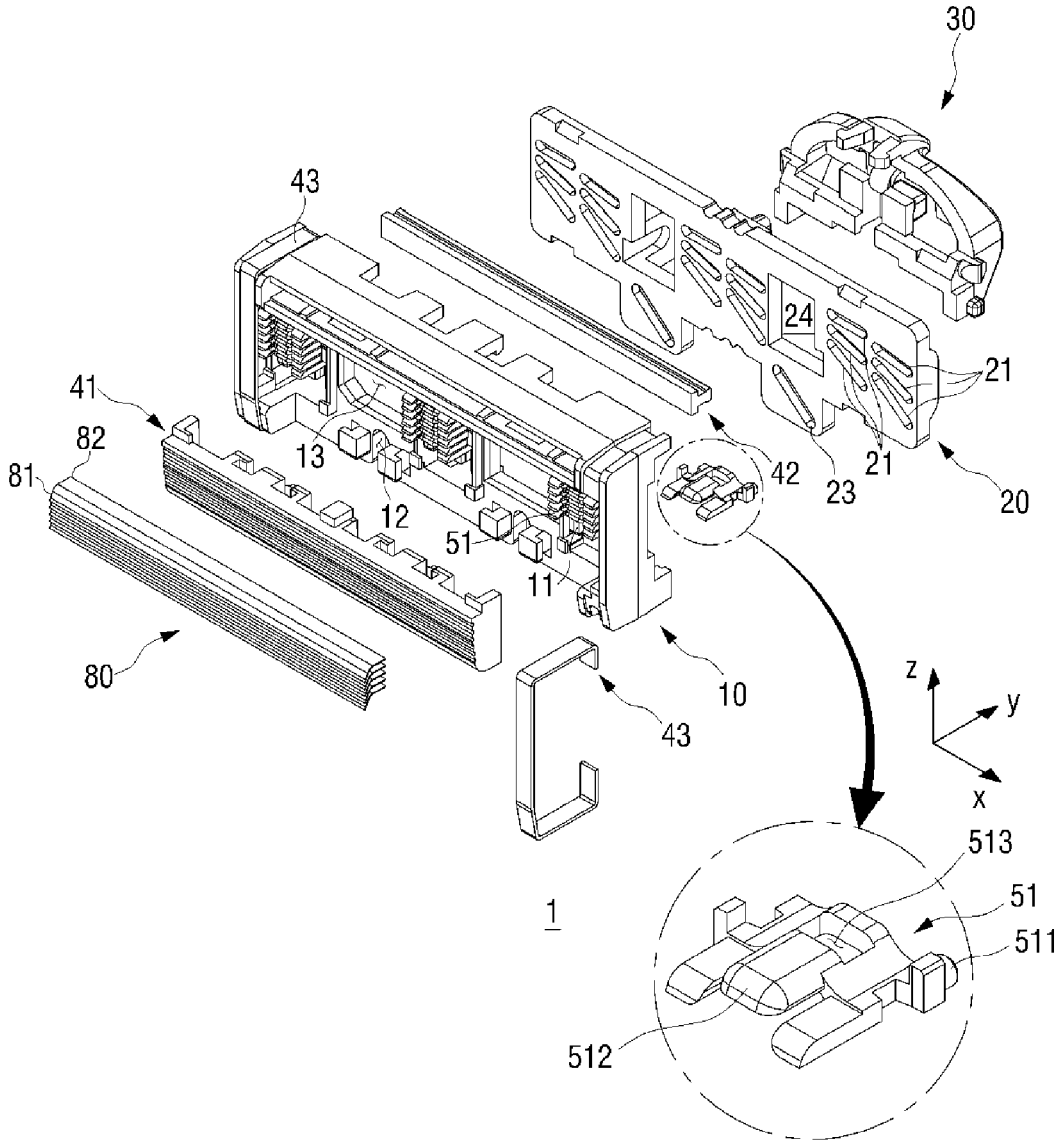
FIG. 3 is an exploded perspective view of the razor cartridge according to the first embodiment.

FIG. 3 is an exploded perspective view of the razor cartridge 1 according to the first embodiment. FIG. 4 is a rear exploded perspective view of the razor cartridge 1 according to the first embodiment.

Figure 4:
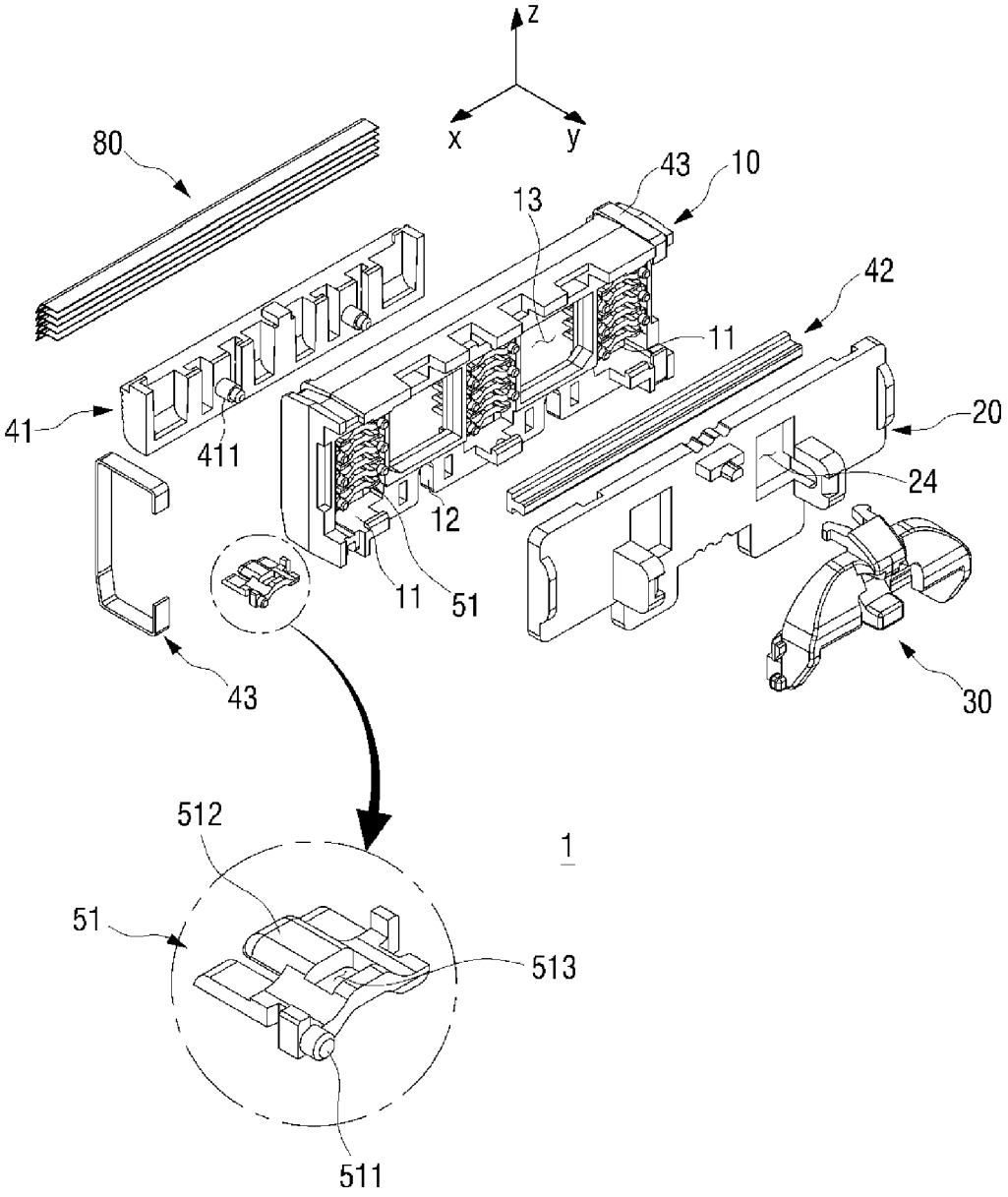
FIG. 4 is a rear exploded perspective view of the razor cartridge according to the first embodiment.

FIGS. 3 and 4 show in detail the shape of each component included in the razor cartridge 1 according to the first embodiment of the present disclosure.

The blades 80 are each a component for cutting hair, and in the present disclosure, they are composed of two or more blades. For each blade 80, a blade formed by bending a planar material having a cutting edge 81 may be used. Alternatively, a razor blade employed may be an unbent flat blade or a steel strip blade made of a bent support with a bladed member welded thereto on its upper surface. The blade 80 is generally made of a metal material, in particular stainless steel. However, the present disclosure is not limited to this, and any material such as ceramics, plastic, or the like can be used as the material of the blade 80 as long as it has a predetermined strength or more to withstand commensurate forces.

The cartridge frame 10 is a skeletal component of the razor cartridge 1 according to at least one embodiment of the present disclosure, and is elongated in one direction.

The cartridge frame 10 is forwardly provided with the upper guard 42 coupled to the upper portion thereof and the lower guard 41 coupled to the lower portion thereof. The plurality of blades 80 are inserted between the upper guard 42 and the lower guard 41. The span adjusting shifter 20 may be slidably coupled to the rear of the cartridge frame 10, and the connector 30 may be coupled to the rear of the span adjusting shifter 20. The connector 30 may be formed to be pivotable in a uniaxial or multiaxial direction with respect to the cartridge frame 10 and the span adjusting shifter 20, but it may be formed in a fixed structure. It is also envisioned that the connector 30 be omitted and the span adjusting shifter 20 be directly coupled to a handle (not shown).

The front and rear of the cartridge frame 10 are at least partially opened to have a front open face into which the plurality of blades 80 is inserted, and rear open through holes 13 into which the connector 30 is inserted and locked by its frame engaging portions. With the cartridge frame 10 opened frontward and rearward, cleaning water may smoothly pass therethrough when cleaning the razor cartridge 1. In the first embodiment of the present disclosure, two total rectangular rear through holes 13 are formed along the first direction, but the shape and the number of the rear through holes 13 of the cartridge frame 10 are not limited thereto, and they may be disposed along the second direction, and the shape thereof is not limited to a rectangular shape.

Figure 5A:
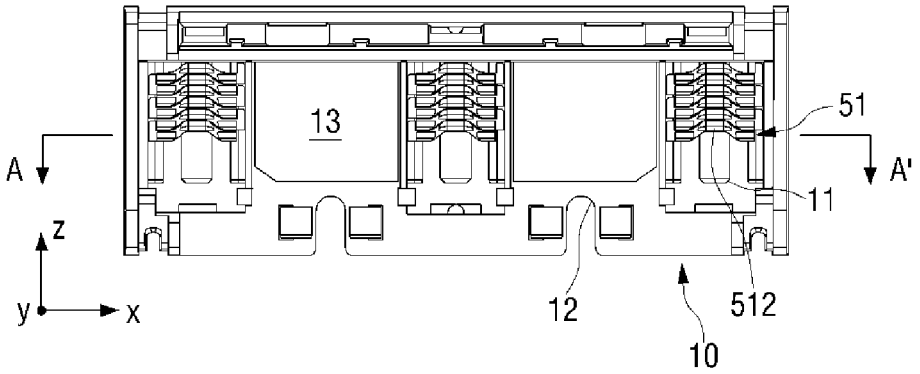
FIG. 5A is a front view of a cartridge frame and multiple blade housings according to the first embodiment.
Figure 5B:
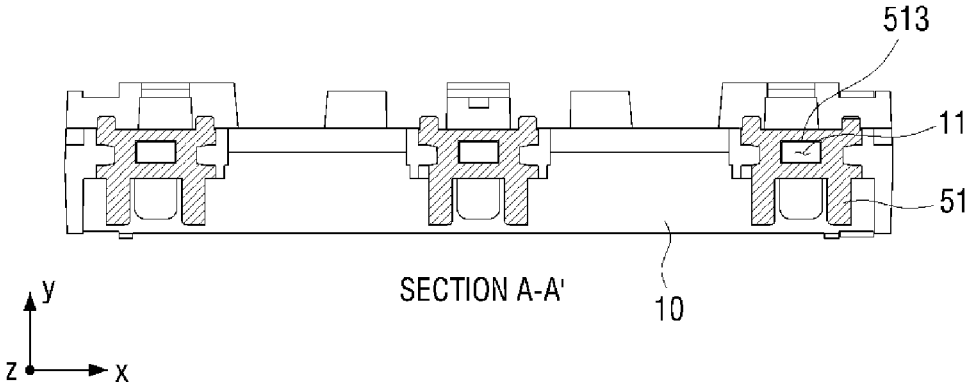
FIG. 5B is a sectional view taken along A-A' line of FIG. 5A.

The cartridge frame 10 is coupled with blade housings 51 further provided, which will be described with reference to FIG. 5A, the front view of the cartridge frame 10 and the multiple blade housings 51 according to the first embodiment. Referring to FIGS. 5A and 5B, the cartridge frame 10 is internally provided with at least one guard bar rail 11 extending in the second direction. The guard bar rail 11 is a component that supports the blade housings 51 with the blades 80 mounted thereon so as to be movable in the second direction and thus has a shape extending in the second direction. The position of the blade housings 51 is determined by the position where the guard bar rails 11 are disposed, and therefore the guard bar rails 11 are appropriately positioned where the blade housings 51 are best disposed to effectively support the multiple blades 80. The first embodiment illustrates that three total guard bar rails 11 are disposed apart from each other along the longitudinal or first direction of the cartridge frame 10, wherein among the three guard bar rails 11, two are disposed at the opposite longitudinal frame ends, respectively, and one is disposed at the center, although the number and the position of the guard bar rails 11 are not limited thereto.

For the guard bar rails 11 to movably support the blade housings 51 in the second direction, the blade housings 51 have at least one rail engaging portion 513, and the guard bar rails 11 are made to conform to the rail engaging portions 513 as will be detailed below. The cartridge frame 10 may be further provided with guide slots 12 for guiding the lower guard 41 by its guard protrusions 411. The cartridge frame 10 may have conforming sections to the shape of each component coupled thereto where each component is coupled.

FIG. 5B is a sectional view taken along A-A' line of FIG. 5A. Specifically, FIG. 5B shows a cross section in which the blade housings 51 are movably coupled to the guard bar rails 11 of the cartridge frame 10. As shown in FIG. 5B, the guard bar rail 11 of the cartridge frame 10 and the rail engaging portion 513 of the blade housing 51 have shapes corresponding to each other, and the rail engaging portion 513 is formed to be slightly larger than the cross-sectional shape of the guard bar rail 11. Therefore, the blade housings 51 can be moved only in the second direction while being supported by the guard bar rails 11 accommodated in the rail engaging portions 513.

Referring back to FIGS. 3 and 4, the blade housing 51 will be described. A separate blade housing 51 is additionally shown enlarged as being disengaged from the guard bar rail 11. The blade housing 51 has a seat 512 into which the blade 80 is inserted and seated, and it serves to fix the blade 80 to the razor cartridge 1. To accommodate and support the plurality of blades 80, multiple blade housings 51 are formed. The seat 512 included in the blade housing 51 may grasp one blade 80, and it may be formed to define a slit corresponding to the blade 80, in particular, its substrate 82 at the opposite side of the cutting edge 81, to accept the insertion of the substrate 82.

The blade housing 51 is supported by the guard bar rail 11 so as to be movable along the second direction. Therefore, the blade housing 51 has the rail engagement portion 513 correspond to the shape of the guard bar rail 11 in order to be able to move along the second direction while being coupled to the guard bar rail 11 formed to extend along the second direction in the form of a bar. The blade housing 51 has the seat 512 formed in front thereof to fix the blade 80 and a span protrusion 511 formed to protrude from the opposite side. The span protrusion 511 is inserted into a span slot 21 formed in the span adjusting shifter 20 as will be described below. The span protrusion 511 may slide and move within the span slot 21, but can not escape to the outside of the span slot 21.

Multiple guard bar rails 11 may be disposed apart from each other in the first direction, which allows the blade housings 51 to be spaced apart from each other along the first direction. Some of the multiple blade housings 51 spaced apart along the first direction are adapted to support different partial areas of the substrate 82 of the same blade 80 for allowing that blade 80 to be fixed to the razor cartridge 1. The razor cartridge 1 of the first embodiment is illustrated as being formed with three total guard bar rails 11 which are each coupled with six blade housings 51, resulting in the razor cartridge including eighteen total blade housings 51. Of the eighteen blade housings 51, three selected blade housings 51 selected respectively from those three engaging guard bar rails 11 are bundled into one set for supporting the same single blade 80. In other words, the substrate 82 of one blade 80 is supported by three different blade housings 51.

Each of the blade housings 51 coupled to the guard bar rail 11 is not immovably fixed but coupled to move in the second direction. The process of moving the blade housing 51 in the second direction will be discussed below in the description of FIGS. 8 and 9.

In order to secure the blade 80 to the razor cartridge 1, fixing may be accomplished throughout the substrate 82 of the blade 80, but it is not necessarily the case that the fixation takes place all over the substrate 82. Therefore, as in the first embodiment of the present disclosure, the three separated blade housings 51 form three paired blade housings for supporting one blade 80 so that a total of six blades 80 are accommodated in the razor cartridge 1 through the blade housings 51.

Figure 6:
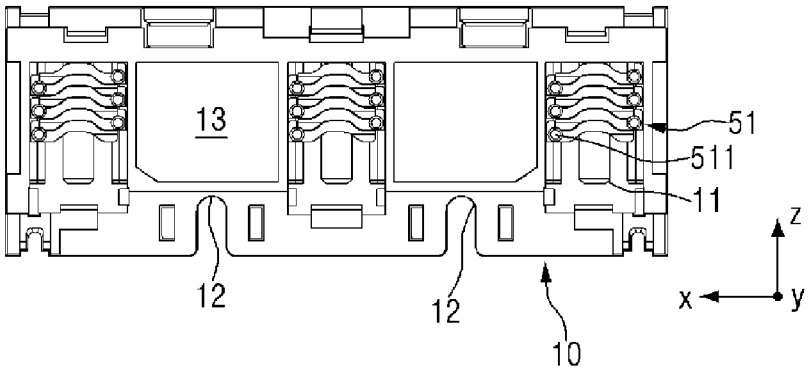
FIG. 6 is a rear view of the cartridge frame and the multiple blade housings according to the first embodiment.

The span protrusions 511 of the multiple blade housings 51 supported by the same guard bar rail 11 may be arranged in a row along the second direction. Alternatively, referring to FIG. 6, which is a rear view of the cartridge frame 10 and the blade housings 51 as assembled together, the span protrusions 511 may be arranged in a zigzag manner as in the first embodiment of the present disclosure. The reason for the zigzag arrangement of the span protrusions 511 will be discussed below in the description of the span adjusting shifter 20.

The blade housings 51 and the cartridge frame 10 may be made of either different or same materials. For example, they may be made of plastics or metal. Materials made of plastic with partial rubber or metal may be used. Other appropriate materials may be selected for use as the components of the razor cartridge 1.

The span adjusting shifter 20 is a component that adjusts the span, which is the spacing between the blades 80. The span adjusting shifter 20 is slidably coupled to the rear of the cartridge frame 10. In the illustrated embodiments herein, the direction in which the span adjusting shifter 20 is slidable is limited to the first direction, although the span adjusting shifter 20 may be configured to be slidable in the second direction among other directions including any third direction between the first and second directions.

The span adjusting shifter 20 is engaged with the rear of the cartridge frame 10 slidably in the first direction so as not to be detached from the cartridge frame 10 during operation, for which a stopper may be formed in the cartridge frame 10 for limiting the range of movement of the span adjusting shifter 20.

Figure 7A:
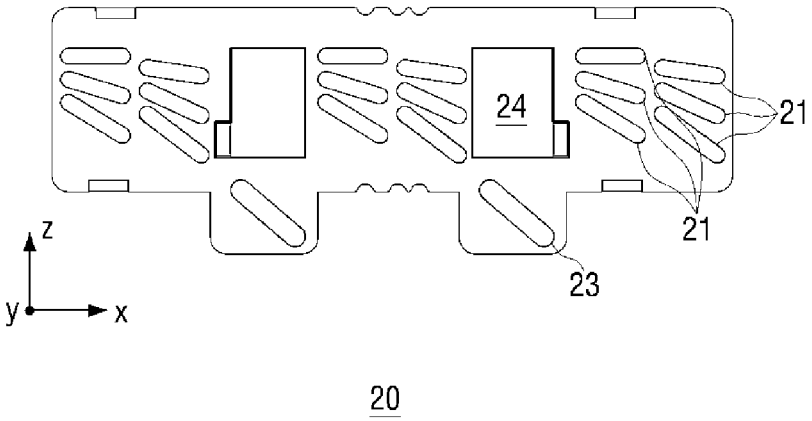
FIG. 7A is a front view of a span adjusting shifter according to the first embodiment.

The front of the span adjusting shifter 20 is coupled to the rear of the cartridge frame 10. The span adjusting shifter 20 is formed on its front surface with the span slots 21 for receiving the span protrusions 511 of the blade housings 51, and with guard slots 23 for receiving guard protrusions 411 provided on the lower guard 41. To explain the span slots 21 and the guard slots 23, reference is also made to FIG. 7A showing the front face of the span adjusting shifter 20. The span slots 21 or the guard slots 23 are represented by grooves as concaves formed on the front surface of the span adjusting shifter 20 in some embodiments herein, although they may be through holes fully penetrating the thickness of the span adjusting shifter 20.

The span slots 21 or the guard slots 23 conform to the shapes of the span protrusions 511 or the guard protrusions 411, respectively, and they are disposed so as to correspond to the positions of the span protrusions 511 or the guard protrusions 411. However, the span slots 21 or the guard slots 23 do not necessarily conform to the span protrusions 511 or the guard protrusions 411, as long as the span slots 21 or the guard slots 23 are larger than the diameter of the span protrusions 511 or the guard protrusions 411, respectively. This allows the span protrusions 511 or the guard protrusions 411 to be accommodated and to move in the slots.

The span slots 21 accommodate the span protrusions 511 therein and serve to forcefully move the blade housings 51 by their span protrusions 511 in the second direction when the span adjusting shifter 20 is moved in one direction according to a user's operation. In the first embodiment of the present disclosure, the one direction is the first direction, wherein the blade housings 51 located stationary at the uppermost position become the reference, and the blade housings 51 thereunder are adapted to move, thereby widening or narrowing the gaps between the blades 80. To keep the uppermost blade housing 51 from moving, the cartridge frame 10 may have its interior upper side structured to secure the blade housings 51.

Therefore, the uppermost span slots 21 into which the span protrusions 511 of the uppermost blade housings 51 are inserted extend in parallel with the first direction. The span slots 21 thereunder extend to form steeper slopes for guiding the span protrusions 511 to move along the second direction, wherein the span protrusions 511 located further downward move farther away along the second direction in response to the movement of the span adjusting shifter 20. The pattern of the span slots 21 in the first embodiment are illustrated as determined with respect to the reference of the uppermost blade housings 51 which are not so limited, but are replaceable by middle-level blade housings 51 or the uppermost blade housings 51.

Figure 7B:
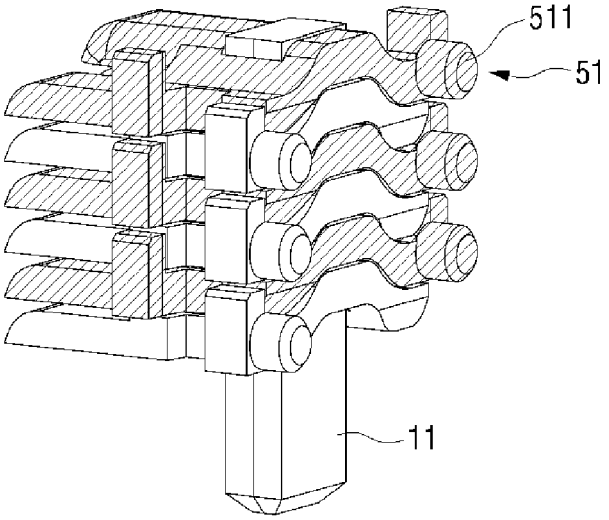
FIG. 7B is an enlarged view of assembled blade housings coupled to a guard bar rail of a cartridge frame, where the blade housings are formed with span protrusions in a zigzag manner, according to the first embodiment.

FIG. 7B is an enlarged view of the blade housings 51 coupled to the guard bar rail 11 of the cartridge frame 10, where the blade housings 51 are formed with span protrusions 511 in a zigzag manner, according to the first embodiment. Referring to FIGS. 7A and 7B, in the first embodiment of the present disclosure, the span protrusions 511 coupled to the same guard bar rail 11 are arranged in two rows in a zigzag manner, and the span slots 21 are formed in two rows correspondingly. In addition, the span protrusions 511 may be arranged in a row, for which the corresponding span slots 21 are supposed to be formed in a row, too.

However, when the span protrusions 511 and the span slots 21 are arranged in a row, the razor cartridge 1 accommodating the plurality of blades 80 may be oversized along the second direction, or to keep the same compact size, the span protrusions 511 and the span slots 21 may need to be formed overly crowded.

This issue is resolved by the zigzag arrangement of the span protrusions 511 and the span slots 21, allowing to use the space more easily and to ensure ease of manufacture. As with the span slots 21, the guard slots 23 receive the guard protrusions 411 formed on the lower guard 41 while forcibly moving the lower guard 41 by its guard protrusions 411 along the second direction responsive to the span adjusting shifter 20 moving in one direction. In the illustrated embodiments, two total guard protrusions 411 are spaced apart from each other in the first direction, but the number and position of the guard protrusions 411 are not limited thereto.

The span adjusting shifter 20 may have the shifter through holes 24 opened frontward and rearward. Through the shifter through holes 24, the connector 30 may have an engagement, and the cleansing water may be drawn in or the shaving residue can be discharged together with the cleansing water, when the razor cartridge 1 is cleaned.

As shown in FIGS. 3 and 4, the connector 30 is a component that is engaged at the back of the span adjusting shifter 20, and it interconnects the razor cartridge 1 with a handle (not shown) to form a complete razor. For this purpose, the connector 30 has a reception space for a mating part of the handle, and a coupling section with the handle, and at the same time, has engaging projections that engage with the rear of the span adjusting shifter 20 so that the handle connects well to the razor cartridge 1. The span adjusting shifter 20 is provided at corresponding positions with coupling slots for coupling with the engaging projections of the connector 30.

The upper guard 42 is a component that projects further from the skin-contacting front surface of the cartridge frame 10 and determines the cutting surface. The upper guard 42 is located on the upper side of the plurality of blades 80 at the front of the cartridge frame 10, and it engages the front of the cartridge frame 10. The upper guard 42 is formed in a rectangular shape in the first embodiment of the present disclosure and is configured to have its forward-facing plane come into contact with the skin when shaving. However, the skin-contacting plane may be modified into a curved surface among other various shapes.

The lower guard 41 is another component similar to the upper guard 42 in that it projects further from the skin-contacting front surface of the cartridge frame 10 and determines the cutting surface. The lower guard 41 is located below the plurality of blades 80 at the front surface of the cartridge frame 10 and may be connected to the span adjusting shifter 20. Alternatively, the lower guard 41 may be coupled to the front of the cartridge frame 10.

The lower guard 41 is provided with the guard protrusions 411. The guard protrusions 411 protrude rearward and are accommodated in the guard slots 23 of the span adjusting shifter 20. Accordingly, the lower guard 41 moves along the second direction similar to the blade housings 51 responsive to the movement of the span adjusting shifter 20.

Materials and shapes of the upper guard 42 and the lower guard 41 may employ those of a rubber guard for helping body hair alignment during body hair cutting, a comb guard, a lubrication band for protecting the skin during hair cutting, and a soap portion. The upper guard 42 and the lower guard 41 may have a structural pattern including, but not limited to, projections, perforations, a wave pattern and the like.

The clips 43 are components used to firmly fix the blades 80 seated in the blade housings 51 to the cartridge frame 10. The clips 43 are each configured to encircle the front and rear of the outer surface of the cartridge frame 10 partially or completely.

The clips 43 may be formed of aluminum or other metal. In the first embodiment of the present disclosure, two total clips are shown as being coupled to both ends in the first direction of the cartridge frame 10, although the arrangement and the number of the clips are not limited thereto.

In addition, although the clips 43 are used in the illustrated embodiments herein, various other means may be employed for securing the blades 80 seated in the blade housings 51 to the cartridge frame 10, such as by coupling caps to both ends in the first direction of the cartridge frame 10.

After the blades 80 are seated in the blade housings 51, the clips 43 are coupled to depress the cutting edges 81 of the blades 80 rearwardly of the cartridge frame 10. The clips 43 may be deformed by pressing the rear of the cartridge frame 10 forward against the clips 43, and thereby securing the clips 43 to the cartridge frame 10.

The clips 43 in the first embodiment illustrated are shown as being structured to cover both ends in the first direction on the front surface of the cartridge frame 10, encircle the upper and lower sides of the cartridge frame 10, and grasp the cartridge frame 10 by the rear surface thereof. In some embodiments, the cartridge frame 10 may have through holes at both ends in the first direction passing through the front and rear walls for allowing the clips 43 to penetrate and attach to the cartridge frame 10.

Further, the through holes for the clips 43 may be formed on just one of the upper and lower sides of the cartridge frame 10 so that the clips 43 each has one side penetrating the cartridge frame 10 and the other side encircling the cartridge frame 10 to the rear, resulting in the clips 43 secured to the cartridge frame 10.

The following describes the process of adjusting the span of the razor cartridge 1 according to the first embodiment with reference to FIGS. 8 to 13.

Figure 8:
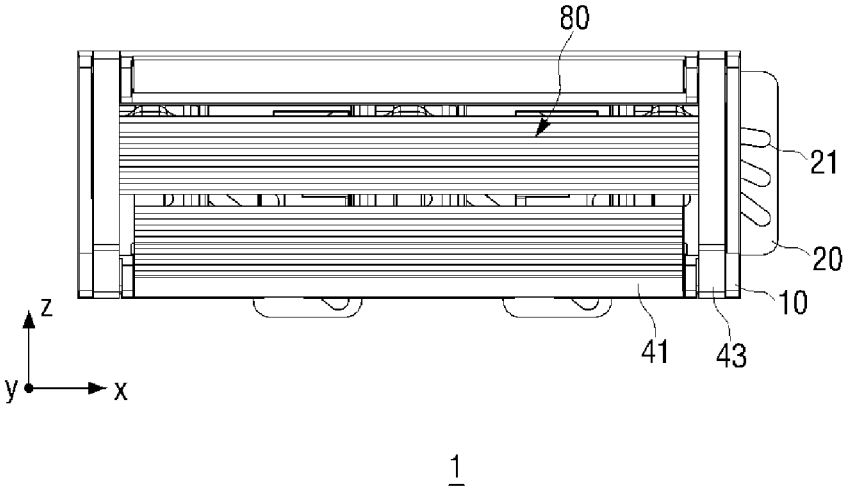
FIG. 8 is a front view of the razor cartridge according to the first embodiment having a minimum span.

FIG. 8 is a front view of the razor cartridge 1 having a minimum span according to the first embodiment. As shown in FIG. 8, the span of the blades 80 of the razor cartridge 1 according to the first embodiment is very small such that the blades 80 are densely packed, and that the span adjusting shifter 20 protrudes to the right side of the cartridge frame 10. The lower end of the span adjusting shifter 20 can be observed from the front thereof partially protruding below the lower guard 41.

Figure 9:
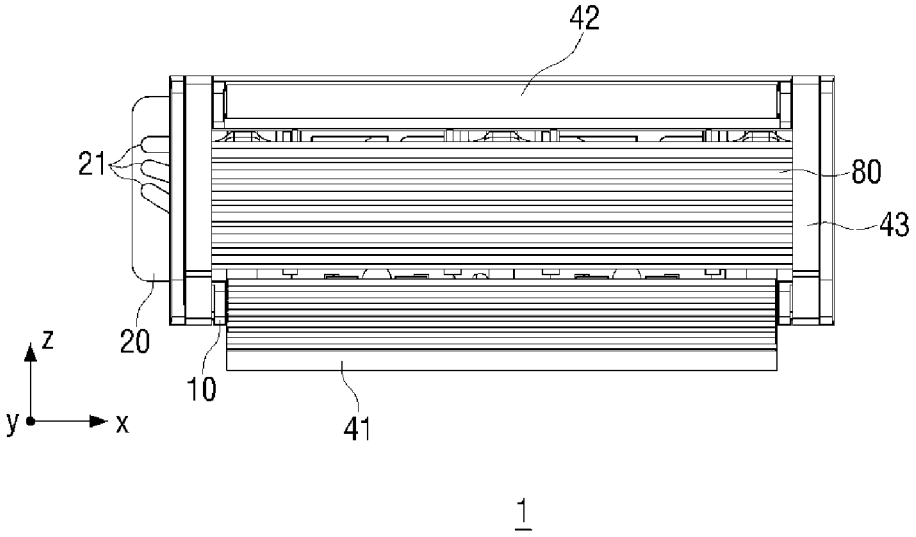
FIG. 9 is a front view of the razor cartridge according to the first embodiment having a maximum span.

FIG. 9 is a front view of the razor cartridge 1 having a maximum span according to the first embodiment. When the user operates the span adjusting shifter 20 to move the same to the left along the first direction of FIGS. 8 and 9, the span adjusting shifter 20 protrudes from the leftside of the cartridge frame 10, expanding the span, and thus increasing the total area of the multiple blades 80. At the same time, the lower guard 41 moves further downward along the second direction blocking the lower end of the span adjusting shifter 20 from being visible from the front thereof. This is because the blade housings 51 and the lower guard 41 have been moved downward along the second direction in response to the movement of the span adjusting shifter 20 in the first direction.

In some embodiments, the span adjusting shifter 20 may be formed so as not to protrude leftward or rightward even after it is moved along the first direction, and may also be formed and manipulated so as to protrude only to either the left or right side of the cartridge frame 10. In some embodiments, to easily move the span adjusting shifter 20 along the first direction, the span adjusting shifter 20 may be provided on its rear surface with a protruding manipulator.

In some embodiments of the present disclosure, the razor cartridge 1 is constructed such that the blade housings 51 are converged adjacent to the upper guard 42 until they move downward along the second direction with the span increasing, allowing the lower guard 41 to accompany the movement of the blade housings 51, while the upper guard 42 is fixed to the cartridge frame 10. However, in other embodiments, the upper guard 42 may be configured to move instead of the lower guard, and the fixed guard may be the lower guard 41, and the blade housings 51 may be made to converge in the area adjacent to the lower guard 41 when the span is at its minimum width.

Figure 10:
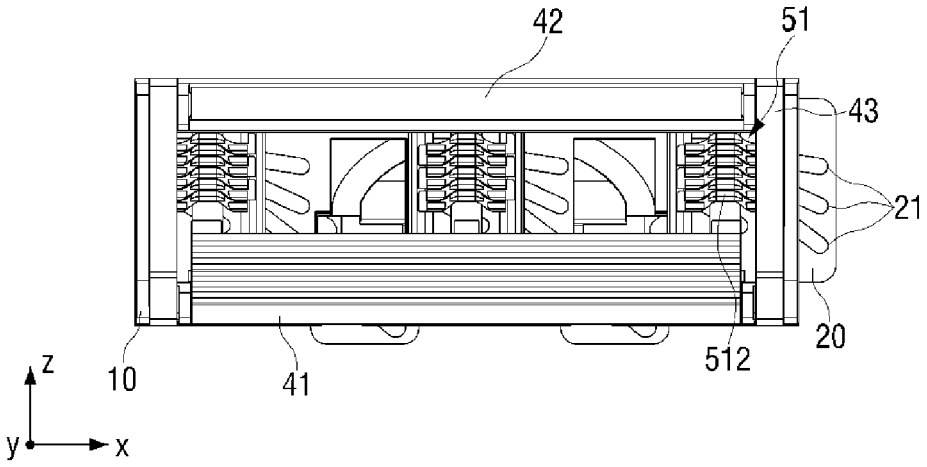
FIG. 10 is a front view of the razor cartridge according to the first embodiment having a minimum span with the blades removed.

FIG. 10 is a front view of the razor cartridge 1 having a minimum span with the blades 80 removed according to the first embodiment.

Referring to FIG. 10, when the span is at its minimum width, the blade housings 51 are converged in the area adjacent to the upper guard 42, and the span adjusting shifter 20 is projected to the right, which is one direction parallel to the first direction. The span slots 21 of the span adjusting shifter 20 are adapted to accommodate the span protrusions 511 of the blade housing 51, meaning that multiple span protrusions 511 are received in the leftmost ends of the multiple span slots 21 in such a configuration. Similarly, the guard slots 23 are in receipt of the guard protrusions 411 at the leftmost ends thereof.

Figure 11:
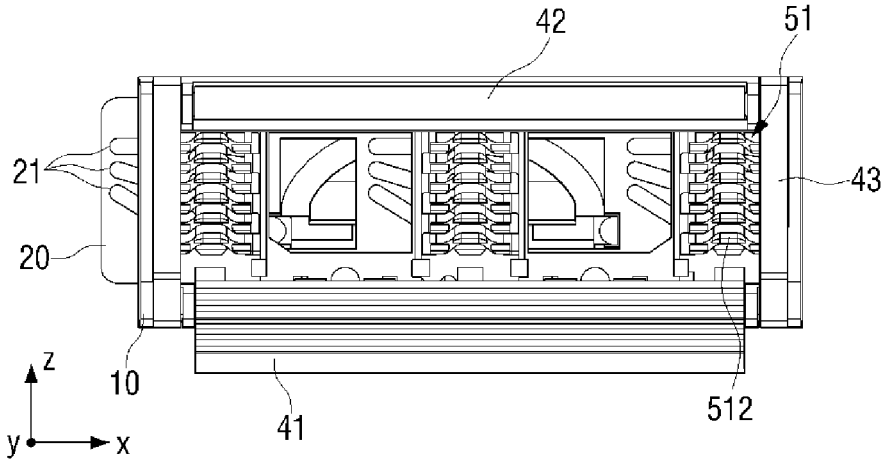
FIG. 11 is a front view of the razor cartridge according to the first embodiment having a maximum span with the blades removed.

FIG. 11 is a front view of the razor cartridge 1 having a maximum span with the blades 80 removed according to the first embodiment.

With the razor cartridge 1 of FIG. 10, the span adjusting shifter 20 is moved by the user's operation to the left along the first direction, which carries therealong the span slots 21 and the guard slots 23. However, except for the span slots 21 located at the uppermost position, the remaining span slots 21 and guard slots 23 have both ends configured to face toward the upper left side and the lower right side, respectively, limiting the blade housings 51 inclusive of the span protrusions 511 and supported by the guard bar rails 11 and the lower guard 41 inclusive of the guard protrusions 411, to move only in the second direction. Accordingly, when the span adjusting shifter 20 moves to the left, the span protrusions 511 and the guard protrusions 411 received in the span slots 21 and guard slots 23 are all, except for the span protrusions 511 located at the uppermost position, lowered in the second direction, which is accompanied by downward movement of the blade housings 51 inclusive of the span protrusions 511 and the lower guard 41 inclusive of the guard protrusions 411. In other words, the span protrusions 511 and the guard protrusions 411 slide in the span slots 21 and the guard slots 23, and move from one end to the opposite end of the span slots 21 and the guard slots 23.

Since movement of the blade housings 51 in the first direction is limited by the guard bar rails 11, the blade housings 51 cannot move in the same direction as the first direction along which the span adjusting shifter 20 moves. However, the blade housings 51 move in the second downward direction as allowed by the supporting guard bar rails 11 because the blade housings 51 are movable in the second direction. Though the lower guard 41 is limited by its own guard protrusions 411 as guided by the guide slots 12 of the cartridge frame 10 from following the movement of the span adjusting shifter 20 along the first direction, it can still slide in the guard slots 23 and move in the second direction.

FIG. 11 exhibits the arrangements of the blade housings 51 and the lower guard 41 when the span is maximized by the operation of the span adjusting shifter 20. It can be seen that the span protrusions 511 and the guard protrusions 411 are located at the right ends of the span slots 21 and the guard slots 23, respectively.

The multiple blade housings 51 move in the second direction during span adjustment, and the displacements of the respective blade housings 51 are different from each other. Moving the respective blade housings 51 by the same displacement would have no effect on span adjustment, merely causing relocation of the entire multiple blade housings 51 along the second direction. The present disclosure in the first embodiment takes the uppermost blade housings 51 as a reference point, resulting in progressively increasing displacement of each blade housing 51 as it moves farther away from the reference point along the second direction.

The process of reducing the span is the opposite of the process of increasing the span. The span is reduced by the user operating the span adjusting shifter 20 in reverse, moving the blade housing 51 in the opposite direction along the second direction.

Hereinafter, a razor cartridge according to a second embodiment of the present disclosure will be described with reference to FIGS. 12 to 14A.

Figure 12:
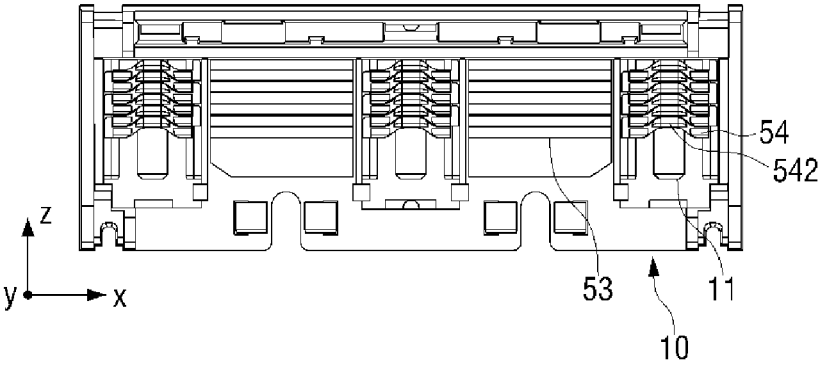
FIG. 12 is a front view of a cartridge frame and multiple blade housings of a razor cartridge according to a second embodiment of the present disclosure.
Figure 13:
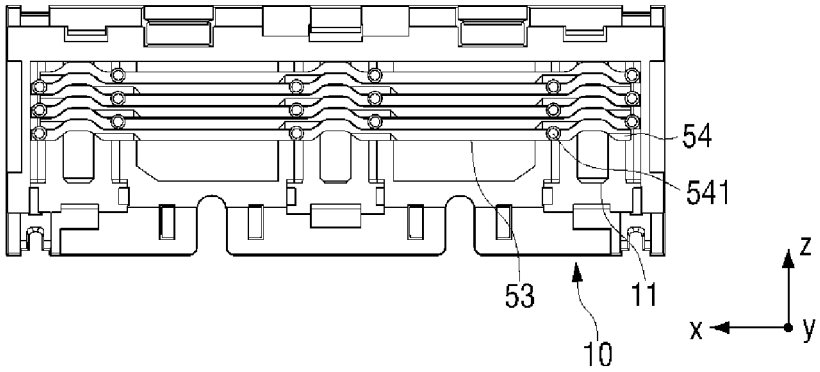
FIG. 13 is a rear view of the cartridge frame and the multiple blade housings of the razor cartridge according to the second embodiment.
Figure 14A:
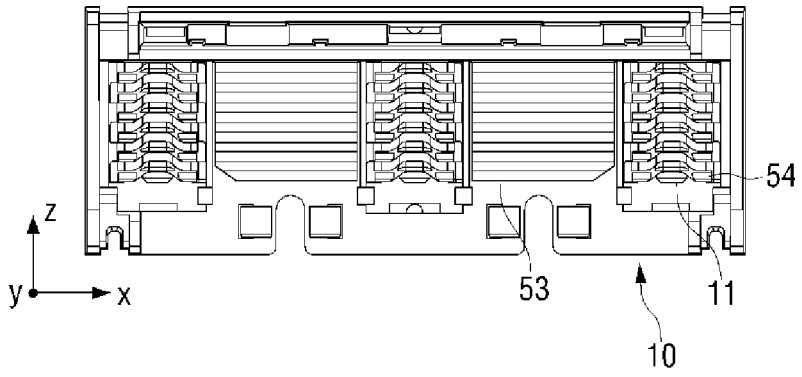
FIG. 14A is a front view of the cartridge frame and the multiple blade housings arranged so as to have a maximum span, according to the second embodiment.

FIG. 12 is a front view of a cartridge frame 10 and multiple blade housings 54 of a razor cartridge according to the second embodiment of the present disclosure, and FIG. 13 is a rear view of the same object. FIG. 14A is a front view of the blade housings 54 disposed in the cartridge frame 10 so as to have a maximum span of the blade housings 54, according to the second embodiment.

Figure 14B:
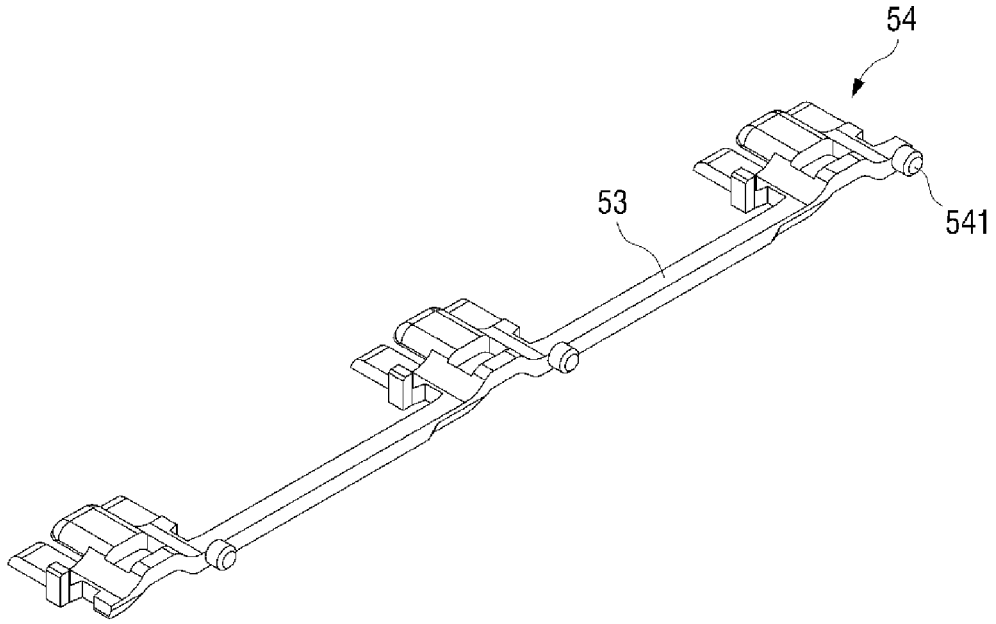
FIG. 14B is a perspective view of a blade housing unit according to the second embodiment.

The razor cartridge according to the second embodiment is generally the same as the razor cartridge 1 according to the first embodiment except that multiple blade housings 54 are conjoined by bridges 53 into a blade housing unit represented by numerals 53 and 54 combined. FIGS. 12 and 13 illustrate that the razor cartridge according to the second embodiment includes the cartridge frame 10, and that the multi-unit blade housings 54 are movably coupled to three guard bar rails 11 formed on the cartridge frame 10, with the bridges 53 extending in the first direction and interconnecting the three blade housings 54 located at each same elevation along the second direction to form the blade housing unit (53 and 54). The first embodiment illustrates that the blade housings 51 are movable independently without being connected to each other, when they support different portions of the same blade. However, as shown in FIG. 14B of the blade housing unit (53 and 54) according to the second embodiment, the blade housings 54 that cooperatively support the same blade in the second embodiment are conjoined by the bridges 53 to form each blade housing unit (53 and 54). This helps to resolve instability issues of independently movable blade housings 54 for supporting the same blade.

Specifically, the blade housings 54 for supporting the same blade are fixedly connected through the bridges 53 to maintain the spacing and orientation of each other, thereby performing their operation more stably. Even if one of the blade housings 54 that support the same blade has one or more span protrusions 541 malfunctioning, the other one or more blade housings 54 linked by the bridges 53 can still successfully move along the second direction in response to the operation of the relevant span adjusting shifter.

The bridges 53 may have their positions determined in the direction parallel to the y-axis where they are connected to the blade housings 54 between their span protrusions 541 and seats 542. This is not to interfere with the functions of the span protrusions 541 and the seats 542. The bridges 53 may integrally connect the blade housings 54 to each other to constitute the blade housing unit (53 and 54) or may be formed as a separate member to be coupled with the blade housings 54.

Hereinafter, a razor cartridge 3 according to a third embodiment of the present disclosure will be described with reference to FIGS. 15 and 16.

Figure 15:
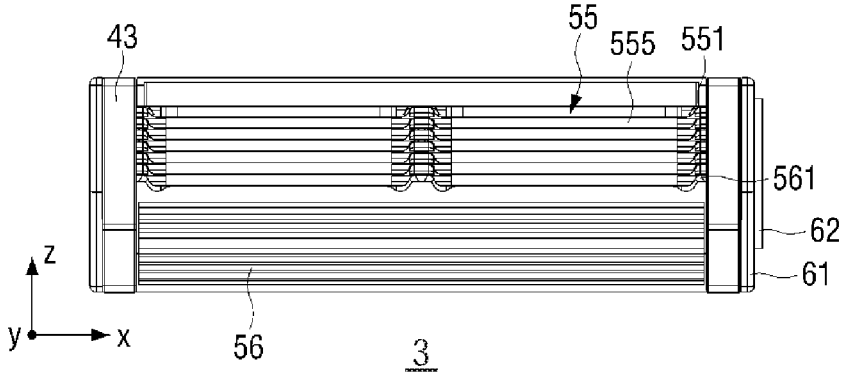
FIG. 15 is a front view of a razor cartridge according to a third embodiment with blades removed.
Figure 16:
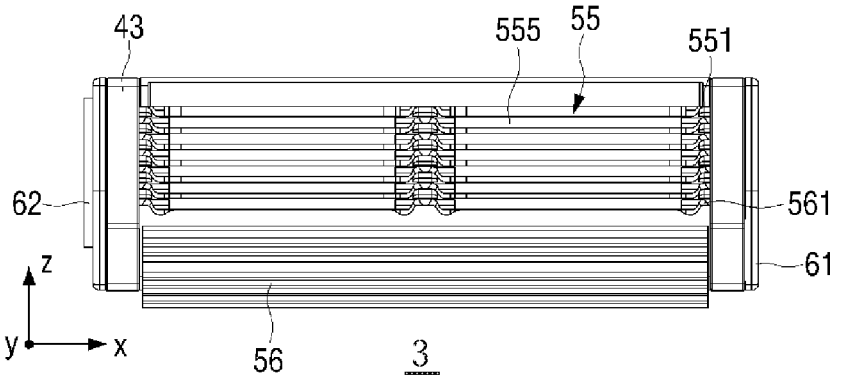
FIG. 16 is a front view of the razor cartridge according to the third embodiment having a maximum span with the blades removed.

FIG. 15 is a front view of the razor cartridge 3 according to the third embodiment with the blades removed. FIG. 16 is a front view of the razor cartridge 3 according to the third embodiment having a maximum span with the blades removed.

The razor cartridge 3 according to the third embodiment of the present disclosure is very similar to, but slightly different from that of the second embodiment. The razor cartridge 3 has blade housings 55, a lower guard 56, a cartridge frame 61 and a span adjusting shifter 62, wherein the blade housings 55 are not connected to the span adjusting shifter 62 located at the rear of the cartridge frame 61 but are coupled to the adjacent blade housings 55 or the lower guard 56 so that the blade housings 55 move in co-operation with the lower guard 56 when moving along the second direction.

Figure 17:
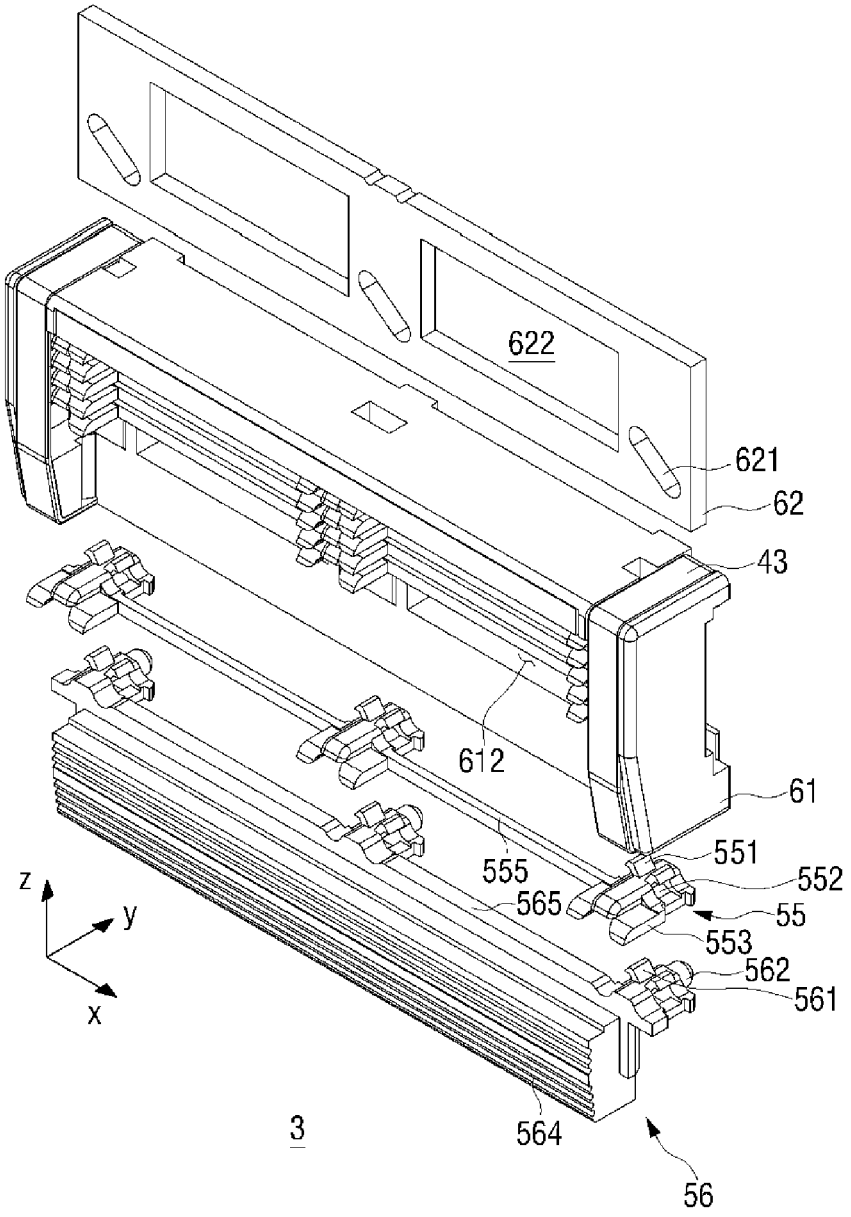
FIG. 17 is an exploded perspective view of the razor cartridge according to the third embodiment with the blades removed.
Figure 18:
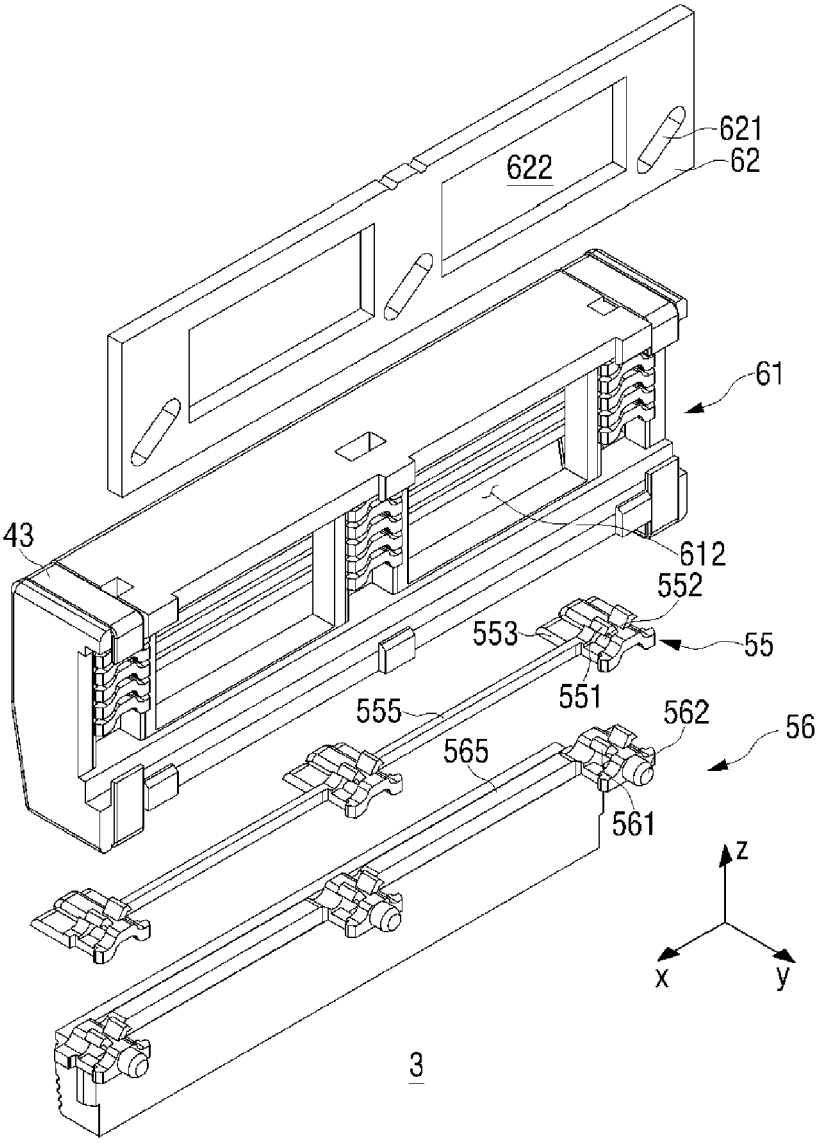
FIG. 18 is a rear exploded perspective view of the razor cartridge according to the third embodiment with the blades removed.

FIG. 17 is an exploded perspective view of the razor cartridge 3 according to the third embodiment with the blades removed. FIG. 18 is a rear exploded perspective view of the razor cartridge 3 according to the third embodiment with the blades removed.

The third embodiment of the present disclosure has the blade housings 55 similar to those of the second embodiment, but not having the guard bar rails 11 of the first and second embodiments and the rail engaging portions 513 for engaging the blade housings 51 and 54 with the guard bar rails 11. Instead, the blade housing 55 of the third embodiment includes housing coupling protrusions 551 and housing couplers 552 with which the housing coupling protrusions 551 of another blade housing 55 may be engaged. Therefore, the cartridge frame 61 maintains only the two rows of rails that can hold both ends in the first direction of the blade housing 55 to prevent the body of the blade housing 55 from coming off.

The razor cartridge 3 according to the third embodiment has the adjacent blade housings 55 interconnected to each other along the second direction or has the blade housing 55 connected to its adjacent lower guard 56. Specifically, when connections are made between the blade housings 55 or between the blade housing 55 and the lower guard 56, housing coupling protrusions 551 and 561 located at the lower levels are coupled to the housing couplers 552 located at the higher levels.

Once coupled, the housing coupling protrusions 551 and 561 and the housing coupling holes 552 are not immovably bound together but are loosely conjoined to allow relative movement between the conjoined blade housings 55 or between the blade housing 55 and the lower guard 56. Gap adjustment between the blade housings 55 would be hampered by a tight binding against such relative movement.

The lower guard 56 of the third embodiment has a structure similar to the lower guard 56 of the second embodiment. The lower guard 56 has a guard portion formed on its front surface and guard protrusions 562 formed on its rear surface, which inherit the features of the lower guard of the second embodiment. However, for coupling with the adjacent blade housing 55, the lower guard 56 of the third embodiment has housing coupling protrusions 561 shaped similar to the housing coupling protrusions 551 of the blade housing 55, and has bridges 565 shaped similar to bridges formed in the blade housing 55. The housing coupling protrusions 561 of the lower guard 56 are engaged with the housing coupling holes 552 of the nearest blade housing 55.

Figure 19A:
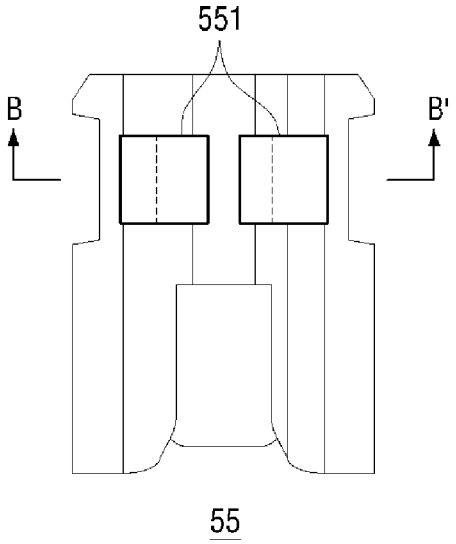
FIG. 19A includes views of an interconnection between housing coupling protrusions and a housing coupler where the arrangement between adjacent blade housings or between the blade housings and a lower guard establishes a minimum span, according to the third embodiment.
Figure 19A:
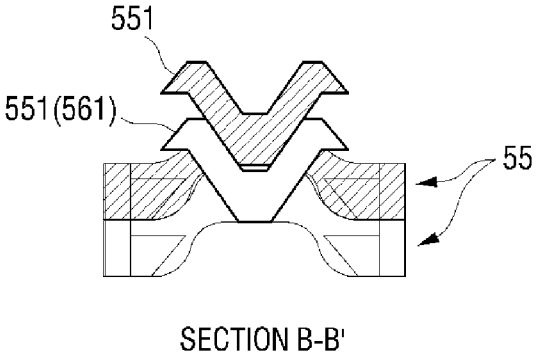
Figure 19B:
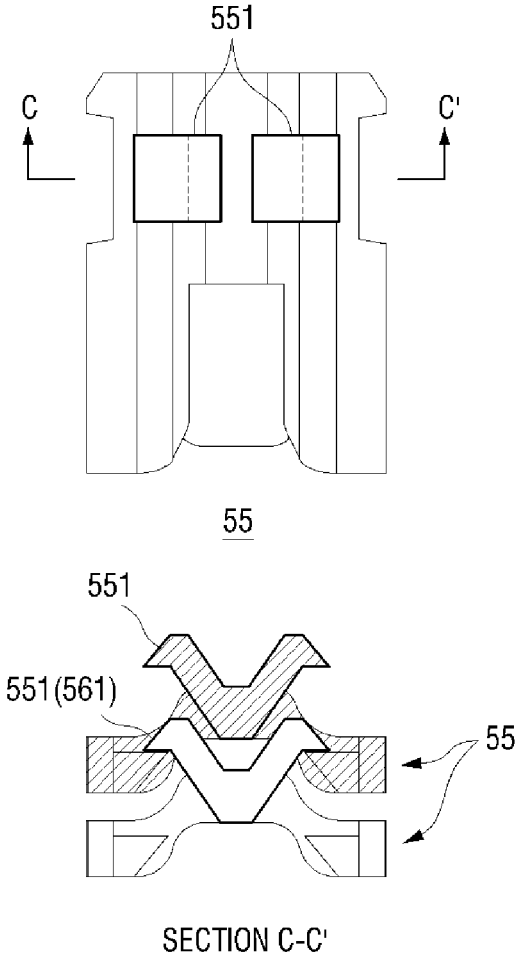
FIG. 19B includes views of an interconnection between housing coupling protrusions and a housing coupler where the arrangement between adjacent blade housings or between the blade housings and a lower guard establishes a maximum span, according to the third embodiment.

FIG. 19A includes views of an interconnection between the housing coupling protrusions 551, 561 and the housing coupling hole 552 where a minimum span is arranged between the adjacent blade housings 55 or between the blade housings 55 and the lower guard 56, according to the third embodiment. FIG. 19B includes views of an interconnection between housing coupling protrusions 551, 561 and the housing coupling hole 552 where a maximum span is arranged between the adjacent blade housings 55 or between the blade housings 55 and the lower guard 56.

Referring to FIG. 19A, with the minimum span arranged between the adjacent blade housings 55 or between the blade housings 55 and the lower guard 56, the housing coupling protrusions 551 and 561 located relatively downward are in close contact but loosely engaged with their superjacent housing coupling holes 552. Here, the housing coupling holes 552 are sized to receive the housing coupling protrusions 551 and 561 by a wide margin, which can move the blade housings 55 and the housing coupling protrusions 551, 561 in the second direction and thereby allows the adjacent housing coupling protrusions 551 and 561 to move vertically away from each other.

As shown in FIG. 19B, the housing coupling protrusions 551, 561 have distal ends bent to extend perpendicularly to the second direction, and in a maximum span arrangement, the bent ends of the subjacent housing coupling protrusions 551, 561 abut their superjacent blade housings at the upper surfaces thereof adjacent to the outer periphery of the housing coupling holes 552 to restrict the movement the subjacent housing coupling protrusions 551, 561 in the second direction. Accordingly, the degree of relative movement between the adjacent blade housings 55 and the lower guard 56 in the second direction may be adjusted by the height at which the distal ends of the housing coupling protrusions 551, 561 are bent.

Conforming to the blade housings 55 having no span protrusions, the span adjusting shifter 62 of the third embodiment does not include a span slot, but includes guard slots 621 and shifter holes 622.

As an alternative to the third embodiment, the lower guard 56 may not be connected to the span adjusting shifter 62 and the blade housing 55, and one blade housing 55 may have its span protrusions be connected to span slots of the span adjusting shifter 62, to adjust the entire span of all blade housings 55.

Hereinafter, the span adjustment process of the razor cartridge 3 according to the third embodiment of the present disclosure will be described with reference to FIGS. 20 to 22.

Figure 20:
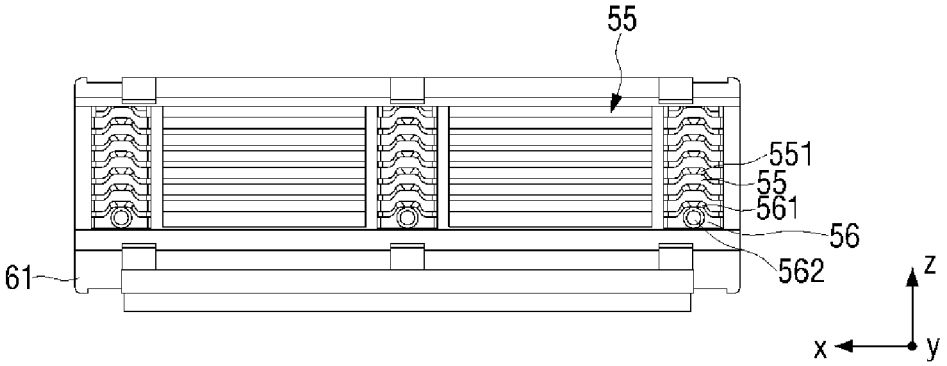
FIG. 20 is a rear view of an arrangement which establishes a maximum span between a cartridge frame and the multiple blade housings with a span adjusting shifter removed, according to the third embodiment.

FIG. 20 is a rear view of an arrangement which establishes a maximum span between the cartridge frame 61 and the multiple blade housings 55 with the span adjusting shifter 62 removed, according to the third embodiment of the present disclosure.

When the cartridge frame 61 is viewed from the rear side with the span adjusting shifter 62 removed, no span protrusions can be seen because the blade housings 55 do not include span protrusions, but housing coupling protrusions 551, 561, which connect between the blade housings 55 and between the blade housings 55 and the lower guard 55, can be seen. Further, the protruding guard protrusions 562 can be seen. FIG. 21 is a rear view of the razor cartridge 3 according to the third embodiment having a minimum span.

Figure 21:
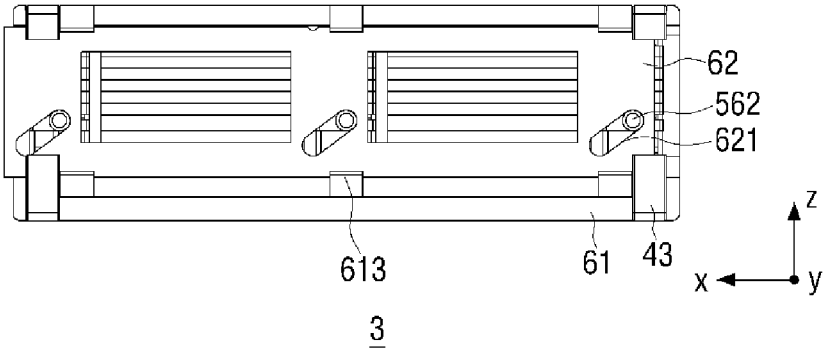
FIG. 21 is a rear view of the razor cartridge according to the third embodiment having a minimum span.

When the span is minimum, the span adjusting shifter 62 is partially protruded to the left side of FIG. 21 in relation to the cartridge frame 61. At the same time, the guard protrusions 562 accommodated in the guard slots 621 are located at the upper right ends thereof when viewed from the rear. Depending on the direction in which the guard slots 621 are formed elongated in the span adjusting shifter 62, the guard protrusions 562 may be positioned at the upper left ends of the guard slots 621 when viewed from the rear. Therefore, the shape of the guard slots 621 formed to move the blade housings 55 and the lower guard 56 in the second direction and the positions of the guard protrusions 562 accommodated in and moved in the guard slots 621 are not limited to the illustrated particulars.

The cartridge frame 61 according to the third embodiment may further include latching portions 613 for preventing the span adjusting shifter 62 from falling out in the direction parallel to the y-axis while allowing it to stably slide along the first direction. The ends of the clips 43 may also cover rear parts of the span adjusting shifter 62 to function like the latching portions 613.

Figure 22:
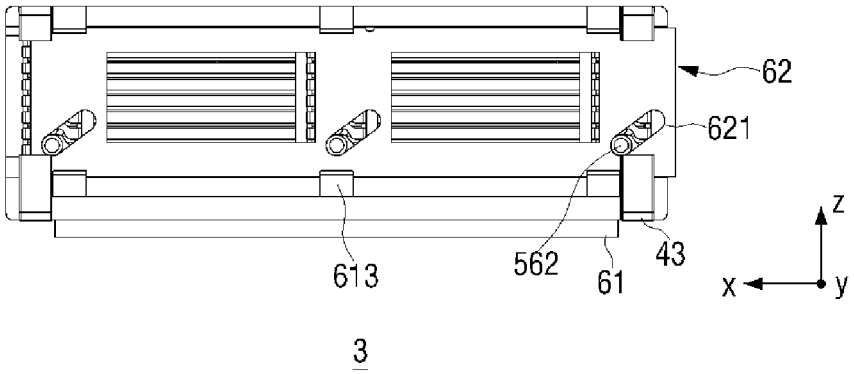
FIG. 22 is a rear view of an arrangement which establishes a maximum span between the cartridge frame and the multiple blade housings, according to the third embodiment.

FIG. 22 is a rear view of an arrangement which establishes a maximum span between the cartridge frame 61 and the multiple blade housings 55, according to the third embodiment.

When the span adjusting shifter 62 is operated or flicked to the right of FIGS. 21 and 22 along the first direction, the guard protrusions 562 are urged to the lower left ends of the guard slots 621 extending to the upper right and lower left ends. However, the lower guard 56 has its guard protrusions 562 accommodated in the guard slots 621, and is thereby limited from moving in the first direction, so that it moves only in the second direction. Therefore, when forced to the lower left ends of the guard slots 621, the lower guard 56 cannot move to the left, thus moving only downward.

The lower guard 56 is connected to the adjacent blade housing 55 through the housing coupling protrusions 561 and the housing coupling holes 552, while the other multiple blade housings 55 are connected to each other through the housing coupling protrusions 551 and the housing coupling holes 552, wherein the lower guard 56 and the multiple blade housings 55 are stacked along the second direction. Accordingly, as the lower guard 56 moves downward along the second direction, the blade housing 55 that is connected to the lower guard 56 moves downward along the second direction, which is followed by the connected blade housings 55.

Figure 23:
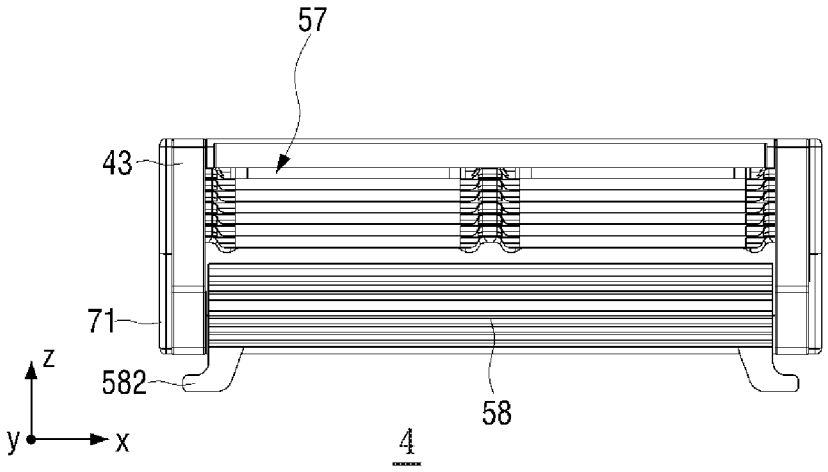
FIG. 23 is a front view of a razor cartridge according to a fourth embodiment with blades removed.

The result of this process is shown in FIG. 23, where the guard protrusions 562 are located at the lower left ends of the guard slots 621 and the blade housings 55 have been moved downward together with the lower guard 56 to achieve the increased span. With this structure, the lower guard 56 can be exclusively controlled by the span adjusting shifter 62 to reduce or increase the span. Manipulating the span adjusting shifter 62 to the left when viewed from the rear, will reverse the above procedure in order to reduce the span.

Figure 24:
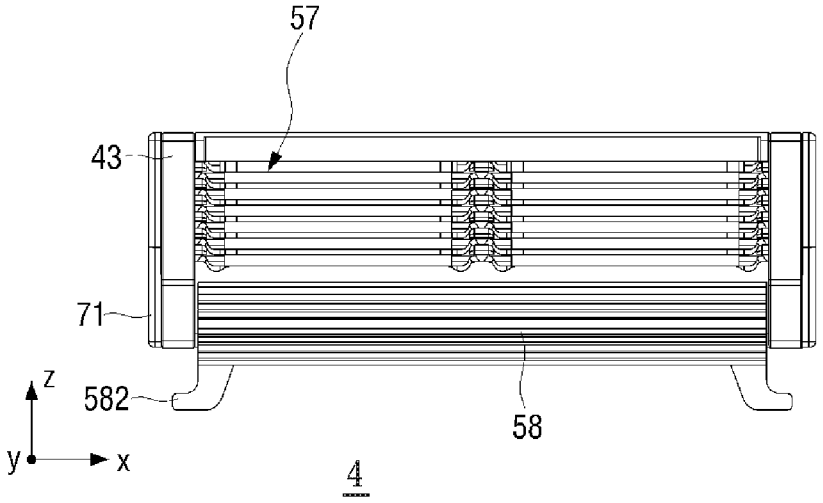
FIG. 24 is a front view of the razor cartridge according to the fourth embodiment having a maximum span with the blades removed.

Hereinafter, a razor cartridge 4 according to a fourth embodiment of the present disclosure will be described with reference to FIGS. 23 and 24.

FIG. 23 is a front view of the razor cartridge 4 according to the fourth embodiment with the blades removed. FIG. 24 is a front view of the razor cartridge 4 according to the fourth embodiment having a maximum span with the blades removed.

The razor cartridge 4 according to the fourth embodiment of the present disclosure is similar to the razor cartridge 3 according to the third embodiment except that a lower guard 58 is provided with span adjustment knobs 582 and that neither a span adjusting shifter nor guard protrusions are provided. The general operation such as the span adjusting process is similar to that of the razor cartridge 3 of the third embodiment, as can be seen in FIGS. 23 and 24.

Figure 25:
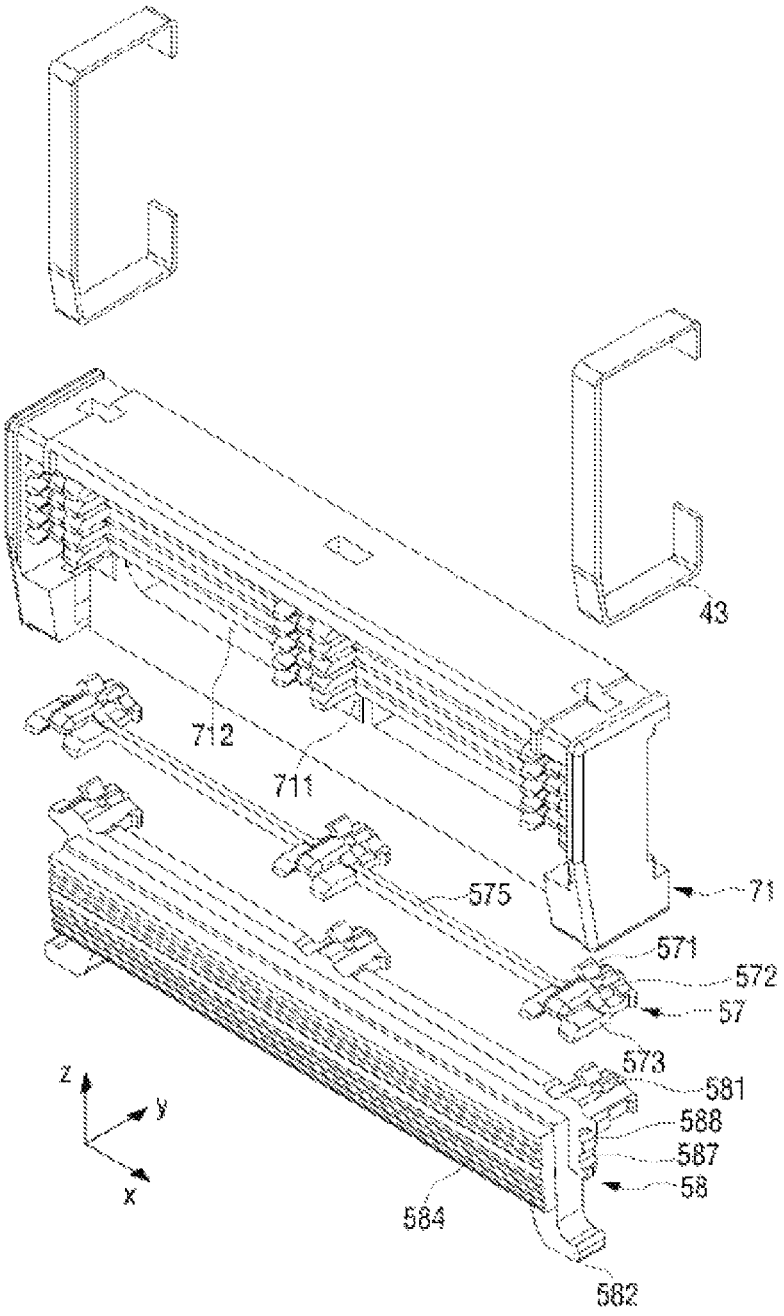
FIG. 25 is an exploded perspective view of the razor cartridge according to the fourth embodiment with the blades removed.
Figure 26:
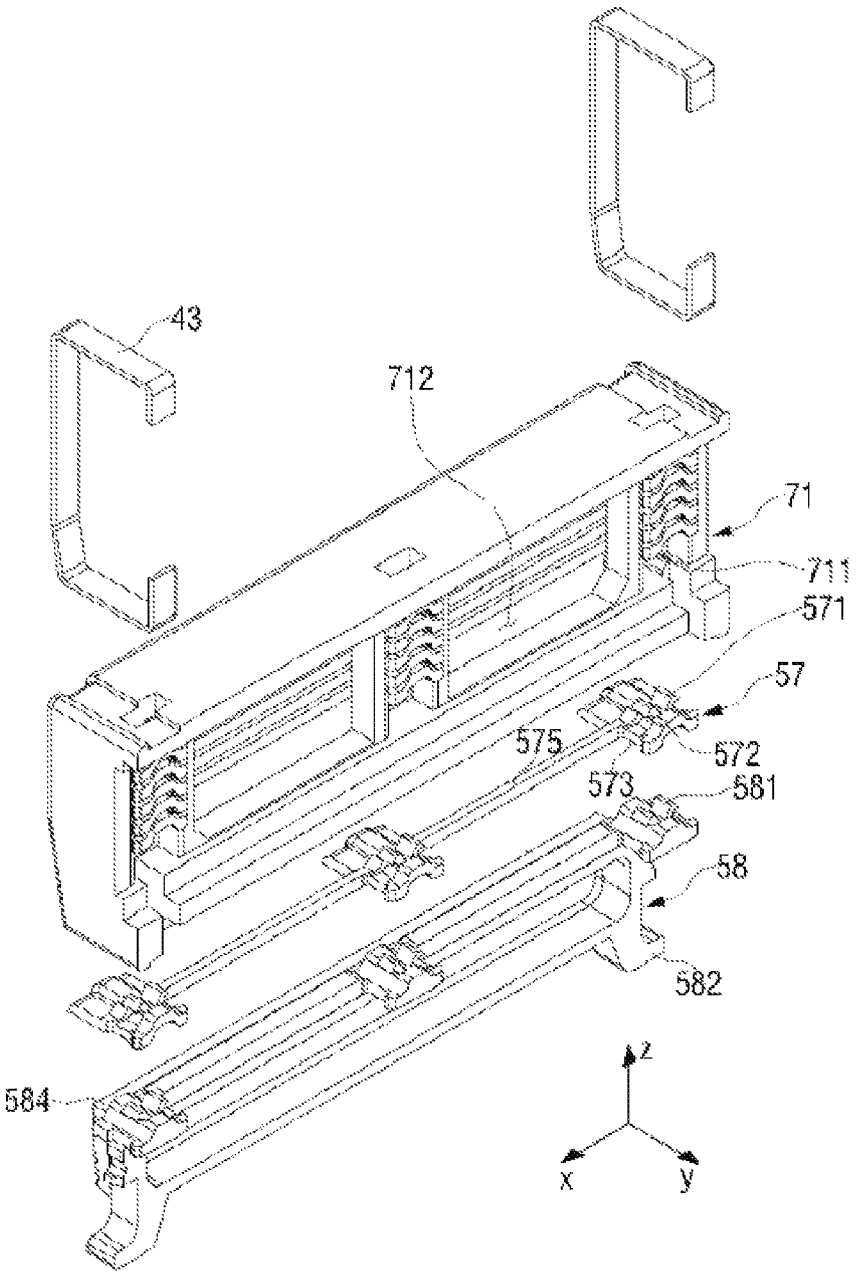
FIG. 26 is a rear exploded perspective view of the razor cartridge according to the fourth embodiment with the blades removed.

FIG. 25 is an exploded perspective view of the razor cartridge 4 according to the fourth embodiment with the blades removed. FIG. 26 is a rear exploded perspective view of the razor cartridge 4 according to the fourth embodiment with the blades removed.

The razor cartridge 4 according to the fourth embodiment does not include a span adjusting shifter, obviating the need for lower guard 58 to include guard protrusions otherwise needed to be connected to the span adjusting shifter. Instead, the lower guard 58 has the span adjustment knobs 582 projecting obliquely downward.

In the fourth embodiment of the present disclosure, two span adjusting knobs 582 are provided so as to protrude obliquely in the downward direction, on both ends in the first direction of the lower guard 58. However, the number and positions of the span adjusting knobs are not limited to the illustrated particulars.

The lower guard 58 includes a guard portion 584 on its front surface and a plurality of stopper slots 587 and 588 recessed on both sides thereof. The stopper slots 587 and 588 are grooves into which stoppers 713 of a cartridge frame 71 to be described below are inserted and the number of the stopper slots 587 and 588 is determined by the number of span types for which the razor cartridge 4 is specified.

Figure 27:
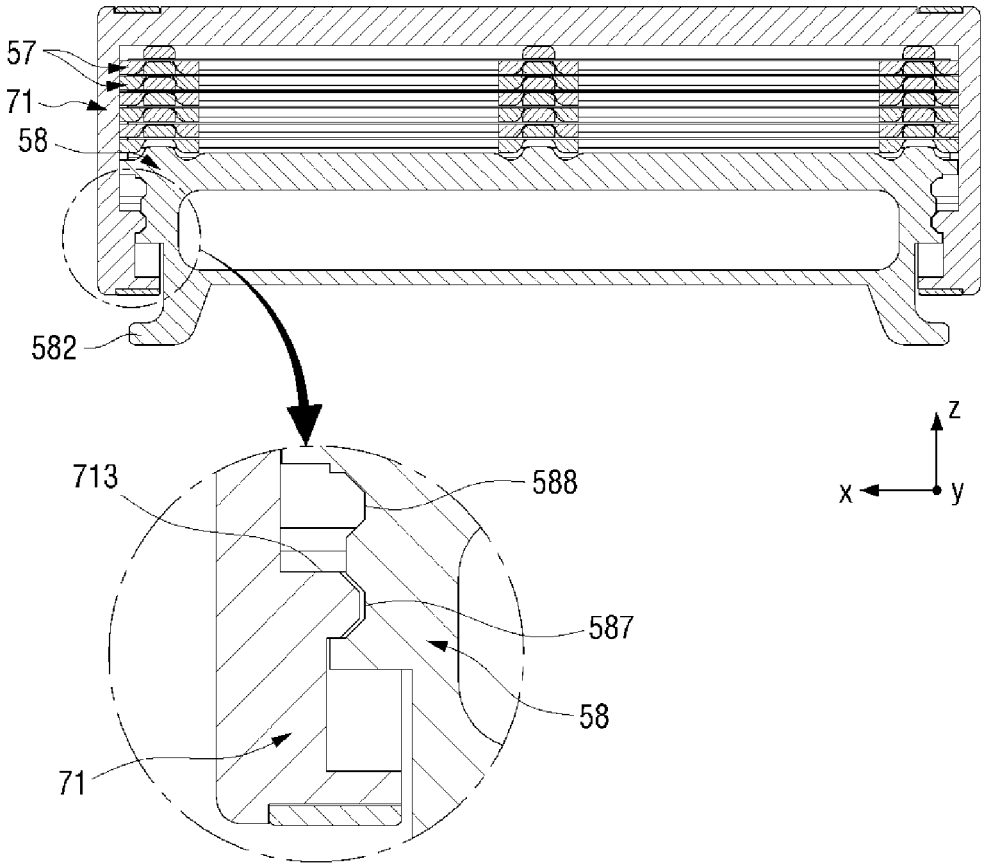
FIG. 27 is a rear view of the razor cartridge according to the fourth embodiment having a minimum span with clips removed.

FIG. 27 is a rear view of the razor cartridge 4 according to the fourth embodiment having a minimum span with the clips 43 removed.

When the span is minimum, the multiple blade housings 57 and the lower guard 58 of the razor cartridge 4 according to the fourth embodiment converge on the upper side.

The span adjustment knobs 582 that replace a span adjusting shifter may be manipulated in the second direction to adjust the span of the blade housings 57.

When shaving, it is typical that the razor cartridge 4, which is in contact with the skin, moves along the second direction to cut hairs by the cutting edges, so that the frictional force by the skin can act on the lower guard 58 in the second direction. Unless a fixture is present, the frictional force may cause the lower guard 58 to move in the second direction and an undesirable span change may occur during the shaving.

Such a problem is resolved by providing stoppers 713 in the cartridge frame 71. The stoppers 713 protrude from the inner surfaces of the cartridge frame 71 where the inner surfaces meet the lower guard 58. The lower guard 58 has a structure in the form of concave stopper slots 587 and 588 which are complementary to the stoppers 713 for catching the same to restrict the movement of the lower guard 58 in the second direction.

Although the stoppers 713 are convex and the stopper slots 587 and 588 are concave in the fourth embodiment, in an alternative embodiment, the stoppers may be concave and the stopper slots may be convex. The present disclosure is not limited to such particular structure as long as the lower guard 58 is fixed in the second direction.

In the fourth embodiment of the present disclosure, two stopper slots 587 and 588 are formed so that the lower stopper slot 587 serves for the minimum span state and the upper stopper slot 588 for the maximum span. However, the number, positions, and span correspondence of the stopper slots 587 and 588 are not limited thereto.

With the lower stopper slot 587 corresponding to the state of minimum span, as shown in FIG. 27, the stoppers 713 of the lower guard 58 in the minimum span state are caught by the lower stopper slots 587, to restrict the movement of the lower guard 58.

Figure 28:
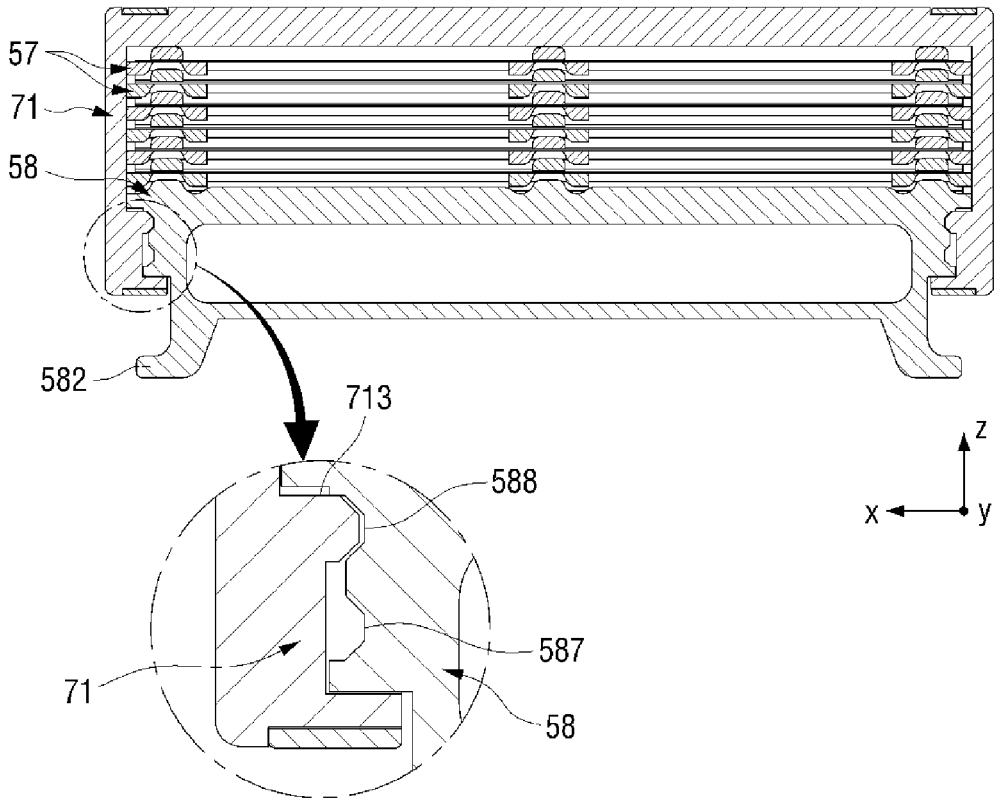
FIG. 28 is a rear view of the razor cartridge according to the fourth embodiment having a maximum span with the clips removed.

FIG. 28 is a rear view of the razor cartridge 4 according to the fourth embodiment having a maximum span with the clips 43 removed.

When the user applies a downward force of a predetermined magnitude or more along the second direction to the span adjustment knobs 582, the maximum static friction force between the lower stopper slots 587 and the stoppers 713 is overcome to shift the lower guard 58 downward, leaving the stoppers 713 to rest in the upper stopper slots 588.

As the lower guard 58 moves downward, the blade housing 57 that is connected to the lower guard 58 also moves downward. Since the multiple blade housings 57 are connected to each other, the remaining blade housings 57 follow down except for the uppermost blade housing 57. This increases the span of the razor cartridge.

With the stoppers 713 located in the upper stopper slots 588, the razor cartridge 4 is kept in the maximum span state.

Figure 29:
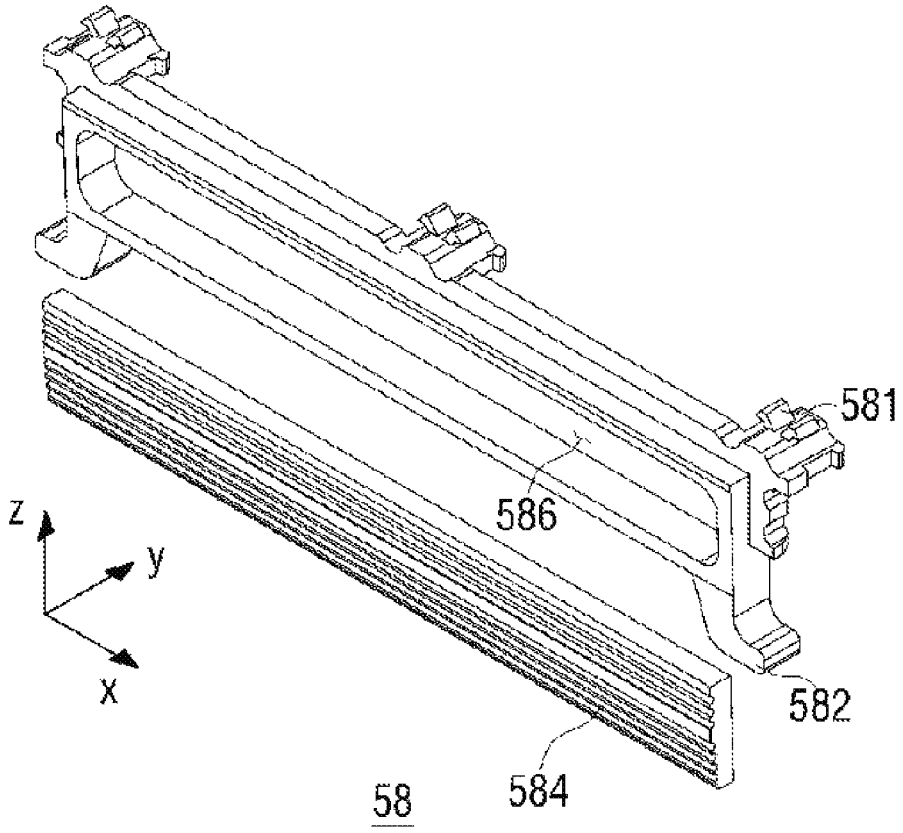
FIG. 29 is a perspective view of a lower guard separated according to the fourth embodiment.

FIG. 29 is a perspective view of the lower guard 58 separated into components according to the fourth embodiment.

The lower guard 58 may include the guard portion 584 integrally, rather than separately as in the instant embodiment to employ the guard portion 584 made of rubber, a lubricant band or such material independent of the lower guard 58. The lower guard 58 may be formed with a guard hole 586 into which the guard portion 584 is coupled to complete the lower guard 58.

It will be understood by those skilled in the art that the present disclosure may be embodied in other specific forms without departing from the technical idea or essential characteristics thereof. It is therefore to be understood that the above-described embodiments are illustrative in all aspects and not restrictive. The scope of the present disclosure is defined by the appended claims rather than the detailed description, and all changes or modifications derived from the meaning and scope of the claims and their equivalents are to be construed as being included within the scope of the present disclosure.

Although the present disclosure has been described in connection with the above-mentioned preferred embodiments, various modifications and variations can be made without departing from the idea and scope of the disclosure. Accordingly, it is intended that the appended claims cover all such modifications and variations as long as they fall within the idea of the disclosure.

What is claimed is:

1. A razor cartridge, comprising:

a plurality of blades;

a plurality of blade housings extended in a first direction and having seats configured to support the plurality of blades;

a cartridge frame having one or more rails configured to support the plurality of blade housings such that the plurality of housings are movable along the one or more rails in a second direction perpendicular to the first direction; and a span adjusting shifter coupled to the plurality of blade housings and configured to cause the plurality of blade housings to move along the one or more rails in the second direction.

2. The razor cartridge of claim 1, wherein the plurality of blade housings are configured to move in the second direction such that a displacement of a first blade housing is different from a displacement of a second blade housing which is adjacent to the first blade housing along a corresponding rail.

3. The razor cartridge of claim 2, wherein when the plurality of blade housings are moved in the second direction, a displacement distance of each blade housing is increasingly larger across the plurality of blade housings.

4. The razor cartridge of claim 1, wherein the plurality of blade housings are configured to move in the second direction in response to a movement of the span adjusting shifter in the first direction.

5. The razor cartridge of claim 1, wherein spans between each of the plurality of blades are equal after the plurality of blade housings are fully moved in the second direction.

6. The razor cartridge of claim 1, wherein:

the plurality of blade housings include a plurality of span protrusions;

the span adjusting shifter includes a plurality of span slots configured to respectively receive the plurality of span protrusions; and the plurality of span protrusions are configured to slide respectively within the plurality of span slots in response to a movement of the span adjusting shifter in the first direction, causing the plurality of blade housings to move in the second direction.

7. The razor cartridge of claim 6, wherein the plurality of span slots are formed in different directions respectively such that the plurality of span protrusions are respectively received in the plurality of span slots so as to be slidable in the different directions.

8. The razor cartridge of claim 1, further comprising:

a lower guard coupled to one end of the cartridge frame in the second direction and including guard protrusions; and an upper guard coupled to another end of the cartridge wherein the span adjusting shifter includes guard slots configured to respectively receive the guard protrusions, and wherein the guard protrusions are configured to slide respectively within the guard slots in response to a movement of the span adjusting shifter in the first direction, causing the lower guard to move in the second direction.

9. The razor cartridge of claim 1, wherein the span adjusting shifter is slidably coupled to the cartridge frame.

10. The razor cartridge of claim 1, further comprising at least one clip configured to secure at least a portion of the plurality of blades at opposite ends of the cartridge frame.

11. The razor cartridge of claim 1, wherein the span adjusting shifter is seated on a first surface of the cartridge frame, which is opposite to a second surface of the cartridge frame for seating the plurality of blade housings.

12. The razor cartridge of claim 1, wherein the rails are spaced apart from each other in the first direction.

13. The razor cartridge of claim 12, further comprising one or more bridges respectively interconnecting two or more blade housings of the plurality of blade housings, wherein the two or more blade housings are supported by different rails and correspond to a single blade of the plurality of blades.

14. The razor cartridge of claim 8, wherein:

the plurality of blade housings are interconnected along the second direction;

the lower guard is connected to one or more blade housings adjacent to the lower guard among the plurality of blade housings; and the lower guard is configured to move in the second direction in response to a movement of the span adjusting shifter in the first direction, causing the interconnected plurality of blade housings to move in the second direction.

15. A razor cartridge, comprising:

a plurality of blades;

a plurality of blade housings extended in a first direction and having seats configured to support the plurality of blades;

a cartridge frame having one or more rails configured to support the plurality of blade housings such that the plurality of blade housings are movable along the one or more rails in a second direction perpendicular to the first direction; and a lower guard supported by the one or more rails and movable along the one or more rails in the second direction with the plurality of blade housings, wherein:

the plurality of blade housings are interconnected along the second direction;

the lower guard is connected to one or more blade housings adjacent to the lower guard among the plurality of blade housings; and the razor cartridge further comprises a span adjusting shifter configured to be moved in the second direction causing the lower guard to be moved in the second direction, wherein the interconnected plurality of blade housings are moved in the second direction in response to the lower guard moving in the second direction.

* * * * *